US008841056B2

(12) United States Patent
Yoshizaki et al.

(10) Patent No.: US 8,841,056 B2
(45) Date of Patent: Sep. 23, 2014

(54) TONER AND PROCESS FOR PRODUCING TONER

(75) Inventors: Kazumi Yoshizaki, Suntou-gun (JP); Shinya Yachi, Mishima (JP); Yasushi Katsuta, Susono (JP); Kenichi Nakayama, Numazu (JP); Takeshi Kaburagi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/582,830

(22) PCT Filed: Mar. 28, 2011

(86) PCT No.: PCT/JP2011/058473

§ 371 (c)(1),
(2), (4) Date: Sep. 5, 2012

(87) PCT Pub. No.: WO2011/122691

PCT Pub. Date: Oct. 6, 2011

(65) Prior Publication Data

US 2012/0328979 A1 Dec. 27, 2012

(30) Foreign Application Priority Data

Mar. 31, 2010 (JP) ..... 2010-080265

(51) Int. Cl.

*G03G 9/087* (2006.01)
*G03G 9/093* (2006.01)
*G03G 9/08* (2006.01)

(52) U.S. Cl.

CPC ..... *G03G 9/0821* (2013.01); *G03G 9/09328* (2013.01); *G03G 9/08795* (2013.01); *G03G 9/09392* (2013.01); *G03G 9/08797* (2013.01); *G03G 9/09321* (2013.01); *G03G 9/09385* (2013.01)

USPC ..... 430/108.5; 430/109.3; 430/110.3; 430/110.4; 430/137.17

(58) Field of Classification Search

USPC ..... 430/109.3, 137.17, 108.5, 110.3, 110.4
See application file for complete search history.

(56) References Cited

U.S. PATENT DOCUMENTS 5,565,293 A 10/1996 Akiyama et al.
5,604,074 A 2/1997 Yasuda et al.
5,679,490 A 10/1997 Yachi et al.
5,747,209 A 5/1998 Takiguchi et al.
5,773,185 A 6/1998 Yachi et al.
5,795,694 A 8/1998 Uchiyama et al.
5,856,055 A 1/1999 Ugai et al.
5,863,697 A 1/1999 Uchiyama et al.
5,948,582 A 9/1999 Nakamura et al.
5,994,019 A 11/1999 Okado et al.
6,077,635 A 6/2000 Okado et al.
6,077,636 A 6/2000 Moriki et al.
6,124,067 A 9/2000 Mikuriya et al.
6,137,977 A 10/2000 Okado et al.
6,183,927 B1 2/2001 Magome et al.
6,187,495 B1 2/2001 Chiba et al.
6,312,862 B1 11/2001 Okado et al.
6,316,157 B1 11/2001 Yoshikawa et al.
6,346,356 B1 2/2002 Ohno et al.
6,372,400 B1 4/2002 Yoshizaki et al.
6,506,531 B1 1/2003 Hakata et al.
6,569,589 B2 5/2003 Inaba et al.
6,638,674 B2 10/2003 Komoto et al.
6,653,035 B2 11/2003 Komoto et al.
6,667,140 B2 12/2003 Tosaka et al.
6,855,471 B2 2/2005 Katsuta et al.
6,936,394 B2 8/2005 Okado et al.
7,014,969 B2 3/2006 Yachi et al.
7,029,813 B2 4/2006 Mikuriya et al.
7,043,175 B2 5/2006 Komoto et al.
7,112,393 B2 9/2006 Komoto et al.
7,153,625 B2 12/2006 Kaburagi et al.
7,160,663 B2 1/2007 Komoto et al.
7,241,546 B2 7/2007 Moriki et al.
7,252,917 B2 8/2007 Ohno et al.
7,306,887 B2 * 12/2007 Tanaka et al. ..... 430/108.4

(Continued)

FOREIGN PATENT DOCUMENTS

JP 3003018 B2 1/2000
JP 3391931 B2 3/2003

(Continued)

OTHER PUBLICATIONS

Lee, et al., "The Glass Transition Temperatures of Polymers", Polymer Handbook, 2nd Edition, 1975, pp. III-139 to III-192.

(Continued)

*Primary Examiner* — Janis L Dote
(74) *Attorney, Agent, or Firm* — Fitzpatrick, Cella, Harper and Scinto

(57) ABSTRACT

A toner is provided which has toner particles and an inorganic fine powder; the toner particles being obtained by suspension polymerization using a specific polar resin. The toner is a toner in which; where, in displacement levels found in a micro-compression test in which a force is applied to a toner single particle at a loading rate of $9.8\times10^{-6}$ N/sec to measure a displacement level (μm) at a point of time where the force has reached a maximum force of $4.90\times10^{-4}$ N, the displacement level of the toner at a measurement temperature of 25° C. is represented by X(25) and the displacement level of the toner at a measurement temperature of 50° C. by X(50), and the number average particle diameter of the toner is represented by D (μm), the X(25), X(50) and D satisfies the relations:

$$0.10\leq X(25)/D\leq 0.35 \quad (1)$$

$$30\leq[X(50)-X(25)]/X(25)\times100\leq150 \quad (2).$$

9 Claims, 6 Drawing Sheets

(56) References Cited

U.S. PATENT DOCUMENTS

| | | | | |
|---|---|---|---|---|
| 7,323,282 | B2 | 1/2008 | Ohno et al. | |
| 7,371,494 | B2 | 5/2008 | Chiba et al. | |
| 7,387,860 | B2 | 6/2008 | Moriki et al. | |
| 7,459,253 | B2 | 12/2008 | Abe et al. | |
| 7,537,875 | B2 | 5/2009 | Mikuriya et al. | |
| 7,560,212 | B2 | 7/2009 | Chiba et al. | |
| 7,704,661 | B2 | 4/2010 | Ikeda et al. | |
| 7,740,999 | B2 | 6/2010 | Inaba et al. | |
| 7,745,088 | B2 | 6/2010 | Yoshizaki et al. | |
| 7,811,735 | B2 | 10/2010 | Nakamura et al. | |
| 7,846,631 | B2 | 12/2010 | Katsuta et al. | |
| 8,053,156 | B2 | 11/2011 | Abe et al. | |
| 8,084,178 | B2 | 12/2011 | Tosaka et al. | |
| 8,247,147 | B2 | 8/2012 | Abe et al. | |
| 8,518,623 | B2 * | 8/2013 | Kamikura et al. | 430/109.3 |
| 2003/0096185 | A1 * | 5/2003 | Yamashita et al. | 430/109.4 |
| 2006/0166120 | A1 | 7/2006 | Moriki et al. | |
| 2008/0124635 | A1 | 5/2008 | Nakamura et al. | |
| 2008/0280218 | A1 | 11/2008 | Sabu et al. | |
| 2009/0130583 | A1 * | 5/2009 | Katsuta et al. | 430/108.5 |
| 2011/0008726 | A1 | 1/2011 | Katsuta et al. | |
| 2012/0328979 | A1 | 12/2012 | Yoshizaki et al. | |

FOREIGN PATENT DOCUMENTS

| | | | |
|---|---|---|---|
| JP | 2005-300937 | A | 10/2005 |
| JP | 2006-221023 | A | 8/2006 |
| JP | 2007-156129 | A | 6/2007 |
| JP | 2007-293183 | A | 11/2007 |
| JP | 2008-9211 | A | 1/2008 |
| JP | 2008-145950 | A | 6/2008 |
| WO | 2009/044726 | A1 | 4/2009 |

OTHER PUBLICATIONS

PCT International Search Report and Written Opinion of the International Searching Authority, International Application No. PCT/JP2011/058473, Mailing Date Jun. 24, 2011.

Chinese Office Action dated Dec. 12, 2013 in Chinese Application No. 201180017526.5.

* cited by examiner

TONER AND PROCESS FOR PRODUCING TONER

TECHNICAL FIELD

This invention relates to a toner used in image recording processes such as electrophotography, electrostatic printing and toner jet recording, and to a process for producing the toner.

BACKGROUND ART

In recent years, in electrophotographic apparatus such as printing apparatus, it is sought from the viewpoint of energy saving to make a toner more advanced which is readily fixable to a transfer material such as paper at a low temperature. At the same time, with an improvement in resolution of images and in order to make them have image quality close to that of photographs (camera pictures) or photogravures, it is needed to control glossiness of images and also, in the case of color machines, to secure color reproducibility with good and wide-range color mixing. For example, it is needed to obtain images having a high glossiness close to that in image quality of photographs.

For that purpose, it is necessary that binder resins used in toners are made to have a lower glass transition point (Tg) or made to have a lower average molecular weight. If, however, the binder resins used in toners are merely made to have a lower Tg or a lower average molecular weight, such toners may have a low toner strength to cause any component members to become contaminated due to toner melt sticking or exudation of wax at the time of development at a high speed or in the case of a non-magnetic one-component developing system that is feasible for making apparatus compact. Also, in an extreme case, the storage stability of toners may be damaged to make any images obtainable.

More specifically, an attempt to merely improve fixing performance results in damage of developing performance. If on the contrary the giving of any precedence to developing performance may fall into a relationship that the fixing performance is not improved. In particular, from the viewpoint of high definition and high image quality, the toners have a tendency to have a smaller average particle diameter, and this makes it difficult to achieve both the resistance to member contamination caused by toner melt sticking or exudation of wax and the performance of low-temperature fixing. It is required for the toners as an important subject to achieve both the developing stability of toner and the low-temperature fixing performance of toner that are apparently contradictory to each other.

In order to settle such a subject, it has become important to control the internal structure of toner particles, and a proposal is made in which the hardness (micro-compression hardness) of a toner single particle as a unit is defined so as to manifest the durability and fixing performance of the toner single particle as a unit.

Patent Literatures 1 and 2 disclose a capsule toner constituted of a heat-fusible central part (core) composed of a thermoplastic resin having a low glass transition point and an outer part (shell) composed chiefly of a non-crystallizable polyester (i.e., having a core-shell structure). According to these Patent Literatures, it is reported that the relationship between a displacement level and a force where the toner single particle is compressed when a force is applied thereto may be defined within a specific range and this enables simultaneous achievement of the low-temperature fixing performance, anti-offset properties and anti-stress properties of toner. This capsule toner, however, has the structure that cores having a low glass transition point are covered with relatively thick shell layers. Hence, although this is effective in a step of fixing under heating and pressing, it is difficult in a step of fixing under light loading to satisfy the low-temperature fixing performance and high image glossiness that are required for the toner. Also, the core material and the shell material may be so low adherent to each other as to come inferior in the running stability of the toner.

Patent Literature 3 discloses a proposal of a toner characterized in that a force-displacement curve obtained by conducting a micro-compression test of toner particles has a displacement point and that the force at that displacement point is larger than the load the toner receives in a developing assembly. According to this Patent Literature, it is reported that the controlling of the displacement point in the force-displacement curve enables a toner to be obtained which may readily rupture by pressure in the fixing step and nevertheless has good durability in the developing assembly and stable charge characteristics. This toner may satisfy the fixing performance in a usual fixing step. However, where the fixing step is made light-load or high-speed, it is difficult for the toner to enjoy a sufficient low-temperature fixing performance and a high image glossiness.

Patent Literature 4 discloses a proposal of a toner in which a force-displacement curve obtained by conducting a micro-compression test of toner particles has a shoulder, where the maximum value at a middle-point position of the shoulder portion is defined and also the slope of force up to that shoulder is large. As the result, oilless fixing can be performed and high-grade images free of any background staining can be obtained in one-component development where the toner is under constant pressure at the part of toner layer thickness control, as so reported. This toner is effective in the oilless fixing. However, in a usual fixing method, it is difficult for the toner to satisfy a sufficient low-temperature fixing performance and a high image glossiness.

Patent Literature 5 discloses a proposal that, in a force-displacement curve obtained by conducting a micro-compression test of toner particles, a displacement level at the time that a constant force is applied at a constant rate is specified to thereby achieve both the anti-stress properties at the time of development and the performance at the time of transfer and fixing. There, however, is still room for improvement where the fixing step is made more high-speed or high-definition full-color images are to be obtained.

CITATION LIST

Patent Literature

PTL 1: Japanese Patent No. 03003018
PTL 2: Japanese Patent No. 03391931
PTL 3: Japanese Patent Application Laid-open No. 2005-300937
PTL 4: Japanese Patent Application Laid-open No. 2008-9211
PTL 5: Japanese Patent Application Laid-open No. 2008-145950

SUMMARY OF INVENTION

Technical Problem

A subject of the present invention is to provide a toner having superior low-temperature fixing performance and running performance and promising a good cleaning performance.

Solution to Problem

The present invention is concerned with a toner which comprises toner particles and an inorganic fine powder; the toner particles being obtained by adding to an aqueous medium a polymerizable monomer composition containing at least a polymerizable monomer, a colorant and a polar resin, granulating the polymerizable monomer composition in the aqueous medium to form particles of the polymerizable monomer composition, and polymerizing the polymerizable monomer contained in the particles of the polymerizable monomer composition; and the toner being a toner in which; where, in displacement levels found in a micro-compression test in which a force is applied to a toner single particle at a loading rate of $9.8\times10^{-6}$N/sec to measure a displacement level (μm) at a point of time where the force has reached a maximum force of $4.90\times10^{-4}$N, the displacement level of the toner at a measurement temperature of 25° C. is represented by X(25) and the displacement level of the toner at a measurement temperature of 50° C. by X(50), and the number average particle diameter of the toner is represented by D (μm), the X(25), the X(50) and the D satisfies the following relations (1) and (2):

$$0.10\leq X(25)/D\leq 0.35 \quad (1)$$

$$30\leq[X(50)-X(25)]/X(25)\times100\leq150 \quad (2)$$

Advantageous Effects of Invention

According to the present invention, a toner can be provided which has superior low-temperature fixing performance and running performance and promising a good cleaning performance.

Further features of the present invention will become apparent from the following description of exemplary embodiments with reference to the attached drawings.

DESCRIPTION OF EMBODIMENTS

Figure 1:
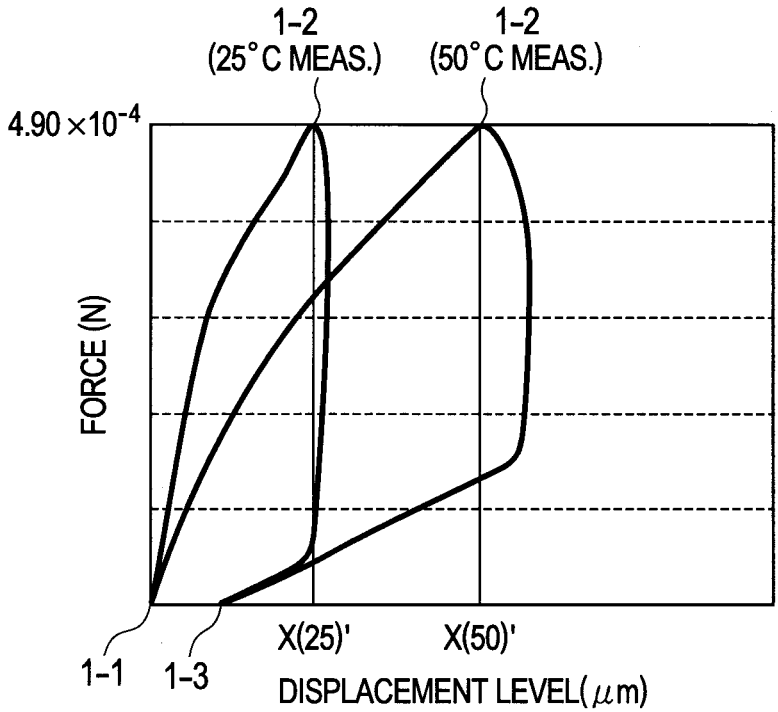
FIG. 1 presents force-displacement curves in a micro-compression test of the toner.

The toner of the present invention is characterized by a toner obtained by what is called suspension polymerization, wherein, where, in a micro-compression test in which a force is applied to a toner single particle at a loading rate of $9.8\times10^{-6}$ N/sec to measure a displacement level (μm) found when the force has reached a maximum force of $4.90\times10^{-4}$ N, the displacement level at a measurement temperature of 25° C. is represented by X(25) and the displacement level at a measurement temperature of 50° C. by X(50), and the number average particle diameter of the toner is represented by D (μm), the X(25), the X(50) and the D satisfies the following relations (1) and (2):

$$0.10\leq X(25)/D\leq 0.35 \quad (1)$$

$$30\leq[X(50)-X(25)]/X(25)\times100\leq150 \quad (2)$$

The feature that the X(25) is "0.10≤X(25)/D≤0.35" in the above micro-compression test means that the displacement level of the toner with respect to the toner number average particle diameter, found when the micro-compression is tested at 25° C., is from 10% to 35%. Offices have a temperature environment of about 25° C., and hence, inasmuch as the measurement temperature is set at 25° C. in the micro-compression test, the stress the toner has in the development, transfer and cleaning processes in such an office environment is considered to be reproduced.

As long as the value of X(25)/D is within the above range, the toner is kept from deteriorating because of any stress in the developing assembly, so that it can maintain a stable developing performance over a long period of time. In addition, the toner has good storage stability and at the same time the toner particles may appropriately deform, and hence any transfer residual toner having remained on a photosensitive member without being transferred therefrom can well be removed by cleaning. Also, where any external additive is used in the toner particles, the external additive can easily adhere to the toner particles and also the external additive can not easily come liberated therefrom even when images are printed on a large number of sheets at a high speed, showing a tendency to improvement in developing performance and transfer performance. The value of X(25)/D may preferably be from 0.10 to 0.30, and much preferably from 0.12 to 0.30. It may further preferably be from 0.12 to 0.25.

The feature that the relationship between the X(50) and the above X(25) is "30≤[X(50)−X(25)]/X(25)×100≤150" means that the rate of change in displacement level found when the micro-compression is tested at 50° C. is from 30% to 150% with respect to the displacement level found when the micro-compression is tested at 25° C. Here, the reason why 25° C. and 50° C. are picked up as measurement temperatures in the micro-compression test is as stated below. Inasmuch as the measurement temperature in the micro-compression test is set at 50° C., the stress the toner has in the fixing process in image formation is considered to be reproduced. This is because the total amount of heat the toner has during measurement is substantially in agreement with the amount of heat the toner has at the time of fixing. Also, inasmuch as the measurement temperature is set at 25° C., as stated above, the stress the toner has in the development or transfer process in the office environment is considered to be reproduced.

Inasmuch as the relationship between the X(50) and the X(25) satisfy the foregoing, images enjoying good low-temperature fixing performance can be obtained while maintaining the running performance during development as stated above. In particular, in secondary images where the toner is in a large laid-on level on a transfer material, the whole toner layer on the transfer material is sufficiently melted, and hence it can have high adhesion to the transfer material. As the result, even where images obtained are superimposed, good images can be stored over a long period of time without causing the toner to come off or to be scraped off. Further, the toner is prevented from being too soft. As the result, any high-temperature offset which involves an image defect can be kept from occurring such that the toner moves unwantedly to the surface of a fixing roller at the time of fixing. The value of [X(50)−X(25)]/X(25)×100 may preferably be from 50 to 150, much preferably from 65 to 140, and particularly preferably from 80 to 130.

In the present invention, the toner may preferably have a number average particle diameter (D) of from 3.0 μm to 8.0 μm. The toner can have number average particle diameter (D) satisfying the above range, by controlling its particle size in a particle size control step such as air classification or sieving when toner particles are produced. It may also be controlled by controlling the amount in which a dispersant is to be fed which is used in granulating the polymerizable monomer composition.

How to make measurement in the micro-compression test is described next with reference to FIG. 1. FIG. 1 is a profile (force-displacement curves) obtained when the toner of the present invention is measured in the micro-compression test. The abscissa represents the displacement level (μm) found when a toner particle has deformed, and the ordinate represents the force (N) applied to the toner particle.

The micro-compression test in the present invention is conducted by using an ultra-micro-hardness meter ENT1100, manufactured by ELIONIX INC. As an indenter used, a flat indenter is used the end face of which is 20 μm×20 μm in area. What is shown by 1-1 in the drawing denotes a state where a toner single particle stands before the force is begun to be applied (force: 0 N; displacement level: 0 μm). The measurement temperature is set at 25° C., where force is applied on to the toner single particle at a loading rate of $9.8\times10^{-6}$ N/sec, where the force is retained for 0.1 second at a point of time where it has reached a maximum force of $4.90\times10^{-4}$ N. Immediately after it has reached the maximum force, the particle is in a state shown by 1-2, and the displacement level of the toner single particle in this state is X(25)' μm. Thereafter, the force applied to the toner single particle is decreased on at an unloading rate of $9.8\times10^{-6}$ N/sec. A point of time where the force applied to the toner single particle has come to 0 N is a state shown by 1-3. The measurement temperature is also set at 50° C., where the same measurement as the above is made so as to find the displacement level X(50)' of the toner single particle.

The procedure of measurement is described below. A ceramic cell is coated thereon with the toner, and air is so blown that the toner may come dispersed on the ceramic cell. Thereafter, this ceramic cell is set in the ultra-micro-hardness meter to make measurement. When set therein, the ceramic cell is brought into a temperature-measurable state, and the temperature of this ceramic cell is taken as the measurement temperature. More specifically, as to the X(25)', the temperature of the cell is set at 25° C. and, as to the X(50)', the temperature of the cell is set at 50° C. The ceramic cell is, after it has reached the measurement temperature, left to stand for 5 minutes or more, and thereafter the measurement is started.

While looking through a microscope attached to the ultra-micro-hardness meter, a measuring screen (breadth: 160 μm; length: 120 μm) is picked up in which the toner is present in a single particle. When picked up, in order to remove any error in the displacement level as far as possible, a particle is picked up the particle diameter of which is within the range of from D−0.2 μm to D+0.2 μm with respect to the number average particle diameter D of the toner. The particle diameter of the particle is measured by using software attached to the ultra-micro-hardness meter ENT1100, where the length and breadth of the particle is measured and the value of [(length+breadth)/2] is taken as the particle diameter.

At each temperature of 25° C. and 50° C., 100 particles are picked up by the above standard to make the measurement. In the case when the measurement temperature is set at 25° C., about the values of X(25)' of the respective 100 particles, 20 particles in the order of those having larger values and 20 particles in the order of those having smaller values are excluded, and the remaining 60 particles are used as data. The value of arithmetic mean of the data of 60 particles is taken as the X(25). Likewise, in the case when the measurement temperature is set at 50° C., too, about the values of X(50)' of the respective 100 particles, 20 particles in the order of those having larger values and 20 particles in the order of those having smaller values are excluded, and the value of arithmetic mean of the data of the remaining 60 particles is taken as the X(50).

How to measure the number average particle diameter D of the toner is as described below.

COULTER MULTISIZER II (manufactured by Beckman Coulter, Inc.) is used, and an interface (manufactured by Nikkaki Bios Co.) that outputs number distribution and volume distribution and a personal computer PC9801 (manufactured by NEC.) are connected. Measurement is made according to an operation manual for the instrument.

Stated specifically, it is measured as described below. As an electrolytic solution, an aqueous 1% NaCl solution is prepared using first-grade sodium chloride. For example, ISOTON R-II (available from Coulter Scientific Japan Co.) may be used. To the above aqueous electrolytic solution, 20 mg of a measuring sample (toner) is added. The electrolytic solution in which the sample has been suspended is subjected to dispersion for 3 minutes in an ultrasonic dispersion machine. The volume and number of toner particles with particle diameters of 2.0 μm or more are measured with the above COULTER MULTISIZER, using an aperture of 100 μm, to determine the number average particle diameter (D).

In toners produced by any conventional suspension polymerization process, it has been unable to satisfy both the relations (1) and (2) set out above. For example, toner particles having core-shell structure, produced by the suspension polymerization process with use of polyester resin as a polar resin, are relatively so soft as to have a value of X(25)/D that is smaller than the range defined in the present invention. Where on the other hand the toner particles are made harder by using a cross-linking agent such as divinylbenzene, the value of X(25)/D may come larger than the range defined in the present invention. In addition, such toner particles have a small difference between the X(50) and the X(25), and hence do not satisfy the relation (2).

In order to satisfy what is defined by the relations (1) and (2) set out above, it is preferable for the toner to have such structure that the toner particles are relatively hard in the vicinity of their surfaces, but are sharp-meltable at their outermost surface layers when heated (sharp-melt properties), and also the toner particles are soft at their interiors. In order to obtain such toner particles, it is firstly preferable for the toner particles to have the core-shell structure. It is further preferable to use, as a binder resin that forms core particles, one having low glass transition point (Tg) and peak molecular weight (Mw) and, in addition thereto, to use as a shell resin two or more types of resins in combination which are a polar resin having high Tg and Mw and a resin having low Tg and Mw.

To obtain the toner having such core-shell structure, the following method may be used, for example.

(1) A polymerizable monomer composition containing the polar resin is granulated in an aqueous medium to carry out polymerization. Thus, shell layers are formed which are composed of the polar resin. The polar resin may be selected taking account of its compatibility with the binder resin that forms core particles.

(2) For the toner particles, the core particles are produced in an aqueous medium and thereafter monomers are added to carry out seed polymerization to form shell layers.

(3) After the core particles have been produced, fine polar resin particles having smaller volume average particle diameter than the core particles are mechanically made to adhere to the core particles. Instead, the fine polar resin particles having smaller volume average particle diameter than the core particles may be made to adhere to the core particles by agglomeration in an aqueous medium, and made to stick fast thereto by heating.

If the core particles and the shells have weak adhesion between them, there is a possibility that the shells come to peel or abrade where the toner continues to have stress during continuous image reproduction, to cause at a certain point of time an abrupt change in surface composition of the toner particles. In such a case, the toner may inevitably come to have low developing performance or transfer performance. In order to obtain the toner satisfying what is defined by the relations (1) and (2) set out above, it is important to use as a part of the shells a polar resin having compatibility with any polymerizable monomer that forms the core particles, so as to form the shells while sufficiently securing their adhesion to the core particles. Further, two or more types of polar resins having different physical properties may be used in combination to form the shells, so as to achieve both developing running performance and low-temperature fixing performance. Stated specifically, it is preferable to use a resin (polar resin A) having a polarity and simultaneously having the compatibility with any polymerizable monomer that forms the core particles and further to use a resin (polar resin B) having a higher polarity than the polar resin A The polar resin A may include the following: Polymers of nitrogen-containing monomers such as dimethylaminoethyl methacrylate and diethylaminoethyl methacrylate, polymers of nitrile monomers such as acrylonitrile, polymers of halogen-containing monomers such as vinyl chloride, polymers of unsaturated carboxylic acids such as acrylic acid and methacrylic acid, polymers of unsaturated dibasic acids or unsaturated dibasic acid anhydrides, polymers of nitro monomers, and polymers of styrene monomers. It may instead be a copolymer of two or more of the above monomers in any combination, which may include, e.g., styrene copolymers such as copolymers of nitrogen-containing monomers with styrene-unsaturated carboxylates, a styrene-acrylic acid copolymer, a styrene-acrylate copolymer, a styrene-methacrylic acid copolymer, a styrene-methacrylate copolymer, a styrene-maleic acid copolymer, a styrene-acrylic acid-acrylate copolymer and a styrene-methacrylic acid-methacrylate copolymer; and also polyesters and epoxy resins.

As the polar resin A, it is preferable to use a polar resin that is close in composition to the polymerizable monomer that forms the core particles. Where the toner is produced by suspension polymerization using a vinyl type polymerizable monomer, it is preferable to use, in particular, a styrene-methacrylic acid copolymer or styrene-acrylic acid copolymer as the polar resin A. This brings a high compatibility between the polar resin A and the binder resin, and hence makes good the adhesion of the shells to the core particles. Stated specifically, the polar resin can be made present in such a way that the concentration of the polar resin A is gradually lower from the toner particle surfaces toward their centers.

Where such a styrene copolymer is used, any residual styrene may be within the range of from 0 to 300 ppm, and this is preferable in order to make the polar resin and the binder resin well compatible with each other.

The polar resin A may preferably be one having a weight-average molecular weight Mw(A) of from 8,000 to 50,000 and a ratio of weight-average molecular weight to number-average molecular weight, Mw(A)/Mn(A), of from 1.05 to 5.00, as measured by gel permeation chromatography (GPC). It may much preferably be one having a weight-average molecular weight Mw(A) of from 10,000 to 30,000.

The polar resin A may preferably have a glass transition point Tg(A) of from 80° C. to 100° C. Further, the polar resin A may preferably have an acid value Av(A) of from 5 mgKOH/g to 30 mgKOH/g, and a hydroxyl value OHv(A) of from 5 mgKOH/g to 50 mgKOH/g. It is also preferable for the polar resin A to have the acid value and the hydroxyl value simultaneously.

The polar resin A may preferably be in a content of from 5 parts by mass to 40 parts by mass based on 100 parts by mass of the polymerizable monomer or binder resin. It may much preferably be in a content of from 5 parts by mass to 30 parts by mass.

Designing the polar resin A as described above makes it easy to obtain the toner satisfying what is defined in the present invention in the micro-compression test.

The polar resin B may include the following: Polymers of nitrogen-containing monomers such as dimethylaminoethyl methacrylate and diethylaminoethyl methacrylate, polymers of nitrile monomers such as acrylonitrile, polymers of halogen-containing monomers such as vinyl chloride, polymers of unsaturated carboxylic acids such as acrylic acid and methacrylic acid, polymers of unsaturated dibasic acids or unsaturated dibasic acid anhydrides, polymers of nitro monomers, and polymers of styrene monomers. It may instead be a copolymer of two or more of the above monomers in any combination, which may include, e.g., styrene copolymers such as copolymers of nitrogen-containing monomers with styrene-unsaturated carboxylates, a styrene-acrylic acid copolymer, a styrene-acrylate copolymer, a styrene-methacrylic acid copolymer, a styrene-methacrylate copolymer, a styrene-maleic acid copolymer, a styrene-acrylic acid-acrylate copolymer and a styrene-methacrylic acid-methacrylate copolymer; and also polyesters and epoxy resins.

In particular, where the toner is produced by suspension polymerization using a vinyl type polymerizable monomer and a styrene-methacrylic acid copolymer or styrene-acrylic acid copolymer is used as the polar resin A, it is preferable to use as the polar resin B the same resin as the polar resin A or a polyester resin. It is particularly preferable to use the polyester resin as the polar resin B.

The polar resin B may preferably be one having a weight-average molecular weight Mw(B) of from 5,000 to 25,000 and a ratio of weight-average molecular weight to number-average molecular weight, Mw(B)/Mn(B), of from 1.05 to 5.00, as measured by GPC. It may much preferably be one having a weight-average molecular weight Mw(B) of from 5,000 to 20,000. It may also be one having a glass transition point Tg(B) of from 60° C. to 80° C.

The polar resin B may preferably be in a content of from 1 part by mass to 20 parts by mass based on 100 parts by mass of the polymerizable monomer or binder resin. It may much preferably be in a content of from 3 parts by mass to 10 parts by mass.

Designing the polar resin B as described above makes it easy to obtain the toner satisfying what is defined in the present invention in the micro-compression test.

The weight-average molecular weights Mw(A) and Mw(B) may preferably be Mw(B)<Mw(A), and the glass transition points Tg(A) and Tg(B) may preferably be Tg(B) <Tg(A). Also, the polar resins A and B may preferably be added in a total content of from 6 parts by mass to 30 parts by mass or less, based on 100 parts by mass of the binder resin, and much preferably from 10 parts by mass to 30 parts by mass or less. Further, where the acid value and hydroxyl value of the polar resin A are represented by Av(A) and OHv(A), respectively, and the acid value and hydroxyl value of the polar resin B are represented by Av(B) and OHv(B), respectively, it is preferable for them to satisfy the relationship of Av(A)+OHv(A)<Av(B)+OHv(B). The relationship of the molecular weights, total content, acid values and hydroxyl values of the polar resins A and B may be controlled as described above, and this enables achievement of a form of preferable shells that the polar resin A is present in the vicinity of surfaces while making the polar resin B present in outermost surface layers.

The toner of the present invention has toner particles obtained by adding to an aqueous medium a polymerizable monomer composition containing at least a polymerizable monomer, a colorant and a polar resin, granulating the polymerizable monomer composition in the aqueous medium to form particles of the polymerizable monomer composition (a granulation step) and polymerizing the polymerizable monomer contained in the particles of the polymerizable monomer composition (a polymerization step).

In the steps of production by such a suspension polymerization process as described above, the polar resins A and B may preferably be added in a period of time of polymerization reaction, of from the granulation step up to the polymerization step. In that case, the state of presence of the polar resins may be controlled in accordance with the balance of polarities between the polymerizable monomer composition that comes to be toner particles and an aqueous dispersion medium. More specifically, it may be so controlled that thin-layer shells of the polar resins are formed on the surfaces of the core particles, or that the polar resins are made present in such a way that the concentration of the polar resins is gradually lower from the toner particle surfaces toward their centers. The addition of the polar resins also enables control of the strength of shell portions in the core-shell structure. Stated specifically, it is preferable that a styrene-methacrylic acid copolymer or a styrene-acrylic acid copolymer is used as the polar resin A and a polyester resin is used as the polar resin B.

Designing the toner particles as described above makes the polar resin A come compatibilized with the core binder resin, and hence toner particles can be obtained which have a core-shell structure with high adhesion in which the respective components stand compatibilized with each other at interfaces between the core particles and the shells. This also promises sufficient adhesion between the polar resins A and B. The reason therefor is unclear, and it is considered probably due to mutual action at polar group moieties the polar resins have. This enables achievement of both running performance and fixing performance of the toner at a high level.

Designing the structure of toner particles as described above makes it easy to obtain the toner satisfying what is defined in the present invention in the micro-compression test.

When the toner particles are produced by suspension polymerization, it is preferable that, taking account of the fact that the Tg rises because the polar resins added come compatibilized with the core binder resin, the theoretical Tg of the monomer for forming the binder resin is set low so that the Tg of the toner to be produced can be within the stated range. In the present invention, the binder resin may preferably have a Tg of from 10° C. to 45° C., and much preferably from 15° C. to 40° C.

When the toner particles are produced by suspension polymerization, an aromatic type organic solvent (e.g., toluene or xylene) may also be added to the monomer, whereby it is promoted that the polar resins that form the shells come compatibilized with the core binder resin and simultaneously undergo phase separation therefrom, to make it easy to bring out the effect of the present invention.

The binder resin of the toner may include a styrene-acrylic acid copolymer a styrene-methacrylic acid copolymer, an epoxy resin and a styrene-butadiene copolymer. The polymerizable monomer used in producing the binder resin may include a vinyl type polymerizable monomer capable of effecting radical polymerization. As the vinyl type polymerizable monomer, a monofunctional polymerizable monomer or a polyfunctional polymerizable monomer may be used. As the polymerizable monomer, it is preferable to use, in particular, the vinyl type polymerizable monomer.

Such a vinyl type polymerizable monomer may include the following:

Styrene; styrene monomers such as o-, m- or p-methylstyrene, and m- or p-ethylstyrene; acrylic or methacrylic ester monomers such as methyl acrylate, methyl methacrylate, ethyl acrylate, ethyl methacrylate, propyl acrylate, propyl methacrylate, butyl acrylate, butyl methacrylate, octyl acrylate, octyl methacrylate, dodecyl acrylate, dodecyl methacrylate, stearyl acrylate, stearyl methacrylate, behenyl acrylate, behenyl methacrylate, 2-ethylhexyl acrylate, 2-ethylhexyl methacrylate, dimethylaminoethyl acrylate, dimethylaminoethyl methacrylate, diethylaminoethyl acrylate and diethylaminoethyl methacrylate; and olefin monomers such as butadiene, isoprene, cyclohexene, acrylonitrile, methacrylonitrile, acrylic acid amide and methacrylic acid amide.

Any of these may be used alone, or may commonly be used in the form of an appropriate mixture of monomers making reference to the theoretical glass transition temperature (Tg) as described in a publication POLYMER HANDBOOK, 2nd Edition III, pp. 139-192 (John Wiley & Sons, Inc.).

The toner of the present invention may preferably have an average circularity of from 0.960 to 1.000. Inasmuch as the toner has average circularity within this range, the area of contact between the toner particles and the photosensitive member can be so small as to lower the attraction force of toner to photosensitive member that is ascribable to mirror force or van der Waals force, and hence the toner can attain a high transfer performance. Also, the toner coat level on a toner carrying member in its lengthwise direction can be so uniform as to enable faithful development of electrostatic latent images by the toner. Further, inasmuch as the X(25) is within the range defined in the present invention, the toner can maintain a good transfer performance even where the toner particle surfaces have come to deteriorate as a result of printing on a large number of sheets.

In the toner of the present invention, particles having an average circularity of less than 0.960 may preferably be in a number of from 2% by number to 30% by number. Inasmuch as the particles having an average circularity of less than 0.960 are in a number within this range, in a toner having any external additive, the external additive can be kept from coming buried in the toner particles for the reason that the toner tends to become densely packed in the developing assembly.

Also, where images having a high print percentage, such as photograph images, are reproduced on a large number of sheets, their density can be kept from varying because of any insufficient feed of the toner onto a developer carrying member. Further, any faulty cleaning caused by an increase in the transfer residual toner can be kept from occurring, or images faithful to electrostatic latent images can stably obtained even when reproduced on a large number of sheets.

In the toner of the present invention, particles having a particle diameter of less than 2 μm may preferably be in a number of from 2% by number to 20% by number. Inasmuch as the particles having a particle diameter of less than 2 μm are in a number within this range, in the toner having any external additive, the external additive can be kept from coming buried in the toner particles for the reason that the toner tends to become densely packed in the developing assembly. Also, where images having a high print percentage, such as photograph images, are reproduced on a large number of sheets, their density can be kept from varying because of any insufficient feed of the toner onto a developer carrying member. Further, this leads the toner to be kept from melt-sticking to any members such as a developer carrying member and an electrostatic latent image bearing member, and enables prevention of image defects such as fog and dots from occurring, where the toner adheres unwantedly to non-image areas.

As to the average circularity of the toner, (1) the pH in an aqueous medium at the time of granulation may be controlled where the toner is produced by suspension polymerization, (2) toner particles are treated to make spherical by heating them in an aqueous medium, or (3) toner particles are treated to make spherical by a mechanical method, and this enables satisfaction of the above range. Also, as to the number of the particles having an average circularity of less than 0.960 and number of particles having a particle diameter of less than 2 μm of the toner, the acid value and hydroxyl value of the polar resin may be controlled, and this enables satisfaction of the above ranges.

The average circularity, number of the particles having an average circularity of less than 0.960 and number of particles having a particle diameter of less than 2 μm of the toner are measured with a flow type particle image analyzer "FPIA-3000 Model" (manufactured by Sysmex Corporation) according to an operation manual for the analyzer.

The principle of measurement with the above analyzer is that particles flowing therein are photographed as still images and the images are analyzed. The sample fed to a sample chamber is sent into a flat sheath flow cell by the aid of a sample suction syringe. The sample having been sent into the flat sheath flow cell forms a flat flow in the state it is inserted in sheath solution. The sample passing through the interior of the flat sheath flow cell is kept irradiated with strobe light at intervals of 1/60 second, thus the particles flowing therethrough can be photographed as still images. Also, because of the flat flow, the particles kept flowing can be photographed in a focused state. Particle images are photographed with a CCD camera, and the images photographed are image-processed at an image processing resolution of 512×512 (0.37 μm×0.37 μm per pixel), and the edge contour of each particle image is extracted, where the projected area and peripheral length of the particle image are measured.

Figure 2:
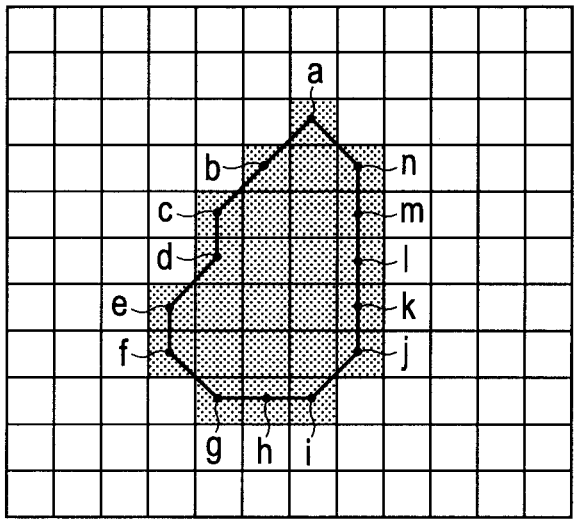
FIG. 2 is a binary-coded image of image data in a flow type particle image analyzer.

In an image processing section, image signals are put to A/D (analog-to-digital) conversion and then placed in storage as image data, where, on the image data thus stored, image processing is performed to distinguish whether or not any particles are present. Next, edge enhancement processing is performed as preprocessing for exactly extracting the edge contour of each particle image. Next, the image data are binary-coded at a certain appropriate threshold level.

Where the image data have been binary-coded at a certain appropriate threshold level, each particle image becomes a binary-coded image as shown in FIG. 2. Next, on each particle image thus binary-coded, judge how edge points (edge contour pixels showing the edge contour) stand, and also take up the information on what directions any edge points face which mutually adjoin an aimed edge point, i.e., write out chain codes.

Next, the projected area S and peripheral length L of each particle image are determined. The projected area S and the peripheral length L are used to determine circle-equivalent diameter and circularity. The circle-equivalent diameter refers to the diameter of a circle having the same area as the projected area of the particle image. The circularity C is defined as a value found when the peripheral length of a circle that is found from the circle-equivalent diameter is divided by the peripheral length of particle projected area, and is calculated by using the following expression.

$$\text{Circularity } C=[2\times(\pi\times S)^{1/2}]/L.$$

The circularity is 1.000 when the particle image is circular. The larger the degree of unevenness of the periphery of the particle image is, the smaller value the circularity has.

The circularity of each particle is calculated, and thereafter the range of circularities of from 0.200 to 1.000 is divided into 800, where the center value of points of such division and the number of particles measured are used to calculate the average circularity by arithmetic mean.

A specific way of measurement is as described below. 10 ml of ion-exchanged water from which impurity solid matter and the like have beforehand been removed is readied in a container, and an alkylbenzenesulfonate is added thereto as a dispersant. Further, 0.02 g of a sample for measurement is added thereto, followed by uniform dispersion. As a means for the dispersion, an ultrasonic dispersion machine UH-50 Model (manufactured by SMT Co.) is used to which a 5 mm diameter titanium alloy tip is attached as a vibrator. Dispersion treatment is carried out for 5 minutes to prepare a fluid dispersion for measurement. Here, the fluid dispersion is appropriately cooled so that the temperature of the fluid dispersion may not exceed 40° C. In the measurement, the above flow type particle analyzer, having a standard lens (10 magnifications), is used and Particle Sheath "PSE-900A" (available from Sysmex Corporation) is used as a sheath solution. The fluid dispersion having been controlled according to the above procedure is introduced into the flow type particle analyzer, where 3,000 toner particles are counted in an HPE measuring mode and in a total count mode. Then, the binary-coded threshold value at the time of particle analysis is set to 85%, and the diameters of particles to be analyzed are limited to circle-equivalent diameters of from 2.00 μm to 200.00 μm, where the average circularity of toner particles is determined.

In regard to the number of the particles having an average circularity of less than 0.960, the diameters of particles to be analyzed are limited to circle-equivalent diameters of from 2.00 μm to 200.00 μm and thereafter average circularities are limited to 0.960 to 1.000 to calculate that number.

In making measurement, autofocus control is performed before the measurement is started, using standard latex particles (e.g., "5200A", available from Duke Scientific Corporation, diluted with ion-exchanged water). Thereafter, the autofocus control is performed at intervals of 2 hours after the measurement has been started.

In Examples of the present invention, a flow type particle image analyzer was used for which a correction certificate issued by Sysmex Corporation was issued. Measurement was made under the measurement and analysis conditions set when the correction certificate was received, except that the diameters of particles to be analyzed were limited to the circle-equivalent diameters of from 2.00 μm to 200.00 μm.

The toner of the present invention may preferably have a melt viscosity at 100° C. of from $5.00\times10^3$ Pa·s to $3.50\times10^4$ Pa·s as measured with a constant-load extrusion type capillary rheometer. Inasmuch as the toner has the melt viscosity within the above range, the wax can appropriately exude to make the toner have better high-temperature anti-offset properties. Also, the toner can maintain an appropriate toughness, and hence can enjoy better developing performance and transfer performance. Further, the toner can have an appropriate adhesion to transfer sheets, and hence can be better effective in regard to low-temperature fixing performance and anti-wind properties. Still also, fixed images having a high glossiness can more easily be obtained.

The melt viscosity at 100° C. of the toner is measured by the following method. It is measured by using a constant-load extrusion type capillary rheometer "Fluidity Characteristics Evaluation Instrument FLOW TESTER CFT-500D" (manufacture by Shimadzu Corporation) and according to a manual attached to the instrument. In this instrument, a constant load is applied from above a measuring sample by means of a piston, during which the measuring sample, which is filled in a cylinder, is melted by raising its temperature (heating). Then, the measuring sample melted is extruded from a die provided at the bottom of the cylinder, where the relationship between the temperature and the level of descent of the piston when it is extruded is measured. The measurement is made at from 50° C. up to 200° C., and apparent viscosity calculated at 100° C. is taken as viscosity (Pa·s) at 100° C. of the toner.

Apparent viscosity η (Pa·s) at 100° C. is calculated in the following way. First, flow rate Q ($cm^3/s$) is calculated according to the following expression (4). In the expression, the sectional area of the piston is represented by A ($cm^2$), and the time taken for the piston to descend by a distance of up and down 0.10 mm (0.20 mm as interval) with respect to the position of the piston at a point of time of 100° C. is represented by Δt (second).

$$Q=(0.20\times A)/(10\times\Delta t) \quad (4)$$

Then, the flow rate Q thus found is used to calculate the apparent viscosity η at 100° C. according to the following expression (5). In the expression, the load applied to the piston is represented by P (Pa), the aperture diameter of the die by B (mm), and the length of the die by L (mm).

$$\eta=(\pi\times B4\times P)/(128{,}000\times L\times Q) \quad (5)$$

As the measuring sample, a cylindrical sample of about 8 mm in diameter is used which is obtained by molding about 1.0 g of the toner by compression at about 10 MPa for about 60 seconds, in an environment of 25° C. and using a tablet compressing machine (e.g., NT-100H, manufactured by NPa System Co., Ltd.). Conditions for measurement with CFT-500D are as shown below.

Test mode: Heating method
Starting temperature: 50° C.
Ultimate temperature: 200° C.
Measurement interval: 1.0° C.
Heating rate: 4.0° C./min
Piston sectional area: 1.000 $cm^2$
Testing load (piston load): 10.0 kgf (0.9807 MPa)
Preheating time: 300 seconds
Aperture diameter of die: 1.0 mm
Length of die: 1.0 mm The melt viscosity can satisfy the above range by controlling the molecular weight or glass transition temperature of the binder resin or controlling the type and content of a wax component. It may also be controlled by polymerization conditions (temperature, the type of an initiator and the amount of the initiator).

The toner of the present invention may preferably contain a wax component in an amount of from 0.5 part by mass to 50 parts by mass based on 100 parts by mass of the binder resin, in order to obtain good fixed images, and much preferably from 3 parts by mass to 30 parts by mass and further preferably from 5 parts by mass to 20 parts by mass. As long as the wax component is in a content within the above range, the toner can well keep from causing low-temperature offset while maintaining its storage stability over a long period of time. It can also maintain good fluidity and image characteristics without hindering dispersion of any other toner materials.

The wax component usable in the toner may include the following: Petroleum waxes and derivatives thereof such as paraffin wax, microcrystalline wax and petrolatum; montan wax and derivatives thereof; hydrocarbon waxes obtained by Fischer-Tropsch synthesis, and derivatives thereof; polyolefin waxes such as polyethylene wax, and derivatives thereof; and naturally occurring waxes such as carnauba wax and candelilla wax, and derivatives thereof. The derivatives of these include oxides, block copolymers with vinyl monomers, and graft modified products. It may further include higher aliphatic alcohols, fatty acids such as stearic acid and palmitic acid, or compounds thereof, acid amide waxes, ester waxes, ketones, hardened caster oil and derivatives thereof, vegetable waxes, and animal waxes. Of these, the ester waxes and the hydrocarbon waxes are particularly preferred from the viewpoint of superior release properties.

Of these waxes, those having a peak temperature at the maximum endothermic peak in a DSC curve as measured with a differential scanning calorimeter (DSC measuring instrument), in the range of from 40° C. to 110° C. are preferred, and those having that in the range of from 45° C. to 90° C. are much preferred. Such a maximum endothermic peak may also preferably have a half width of 2° C. to 15° C., and much preferably 2° C. to 10° C. The half width of the endothermic peak refers to the temperature width of an endothermic chart at the part showing the value of ½ of the peak height from the base line at the endothermic peak. Inasmuch as the half width is within this range, the wax has an appropriate crystallizability and an appropriate hardness, and hence can keep any photosensitive member and charging member from being contaminated therewith.

The toner of the present invention may preferably have a maximum endothermic peak coming from the melting point of the wax, in the range of from 70° C. to 120° C. in a DSC curve as measured with a differential scanning calorimeter.

The DSC curve is obtained by measurement made according to ASTM D3418-82 using a differential scanning calorimeter (DSC measuring instrument) DSC-7 (manufactured by Perkin-Elmer Corporation). Stated specifically, the measurement is made in the following way.

A sample for measurement is precisely weighed in an amount of about 10 mg. This sample is put in an aluminum pan and an empty aluminum pan is used as reference. Measurement is made in a normal-temperature and normal-humidity environment at a heating rate of 10° C./min within the measuring temperature range of from 30° C. to 200° C. In the course of this heating, the endothermic peaks of the wax and the maximum endothermic peak of the toner are found.

The toner of the present invention may preferably have a glass transition point (Tg) of from 30° C. to 58° C., and much preferably from 40° C. to 55° C. as measured with the differential scanning calorimeter (DSC measuring instrument).

A method for measuring the Tg of the toner may make use of basically the same instrument as that in the method of obtaining endothermic peaks of the wax, but there may be a case in which the DSC melting point peak of the wax and the Tg of the toner overlap with each other. Accordingly, a modulation mode is used, and the measurement is made under the following conditions, where the Tg of the toner is determined from a peak position in a DSC curve obtained at the first-time heating. Incidentally, the glass transition temperature of the core binder resin and the glass transition temperatures of the shell binder resins (polar resins A and B) may also be measured in the same way. About the glass transition temperature of the core binder resin, it is difficult to isolate only the core binder resin from the toner particles, and hence a theoretical Tg calculated from its formulation may be regarded as the Tg of the core binder resin.

Measurement conditions:

Keep balance at 20° C. for 5 minutes.

Under a modulation of 1.0° C./minute, raise temperature up to 140° C. at a rate of 1° C./minute.

Keep balance at 140° C. for 5 minutes.

Decrease temperature down to 20° C.

The glass transition temperature (Tg) herein referred to is determined by the middle-point method. Also, the peak temperature (P1) at the maximum endothermic peak of the toner refers to the temperature showing the maximum value among endothermic peaks. Where two or more endothermic peaks are present, the largest in height from the base line in the region of endothermic peaks or higher is regarded as the endothermic peak.

The toner of the present invention may preferably have a main peak molecular weight Mp of from 10,000 to 40,000, and much preferably from 15,000 to 35,000, as measured by GPC of tetrahydrofuran(THF)-soluble matter. Inasmuch as it has main peak molecular weight within this range, the wax may exude from toner particles so appropriately that the toner can have good high-temperature anti-offset properties. The toner also has an appropriate strength, and hence it can enjoy good developing performance and transfer performance. Further, it can have good properties in regard to low-temperature fixing performance as well.

The above requirements concerned with the main peak molecular weight Mp of the toner may be satisfied by controlling temperature and polymerization conditions (temperature, the type of an initiator and the amount of the initiator).

The main peak molecular weight of the THF-soluble matter of the toner and the weight-average molecular weights Mw(A) and Mw(B) and number-average molecular weights Mn(A) and Mn(B) of the polar resins A and B are measured by the following method.

A measuring sample is prepared in the following way. A sample is mixed with THF in a concentration of about 5 mg/ml, and the mixture obtained is left to stand at room temperature for 5 to 6 hours, followed by thorough shaking so as to well mix the sample with the THF until any coalescent matter of the sample has disappeared. This is further left to stand at room temperature for 24 hours. Thereafter, one having been passed through a sample treating filter (pore size: 0.45-0.5 μm; e.g., MAISHORIDISK H-25-2, available from Tosoh Corporation, or EKIKURODISK 25CR, available from German Science Japan, Ltd., may be used) is used as the sample for GPC.

Measurement Conditions

Instrument: High-speed GPC "HLC8120 GPC" (manufactured by Tosoh Corporation).

Columns: Combination of seven columns, Shodex KF-801, KF-802, KF-803, KF-804, KF-805, KF-806 and KF-807 (available from Showa Denko K.K.).

Eluent: THF.

Flow rate: 1.0 ml/min.

Oven temperature: 40.0° C.

Amount of sample injected: 0.10 ml.

To calculate the molecular weight of the sample, a molecular weight calibration curve is used which is prepared using a standard polystyrene resin (TSK Standard Polystyrene F-850, F-450, F-288, F-128, F-80, F-40, F-20, F-10, F-4, F-2, F-1, A-5000, A-2500, A-1000, A-500; available from Tosoh Corporation).

The toner of the present invention may preferably make use of a polar resin C which is a polymer or copolymer having a sulfonic acid group, a sulfonic salt group or a sulfonic ester group.

Incorporation of such a polar resin C enables the toner to achieve both running performance and fixing performance and be more improved in storage stability. The toner can also be improved in charge controllability, and the toner coat level on a toner carrying member in its lengthwise direction can be so improved in uniformity as to enable faithful development of electrostatic latent images on a photosensitive member. The toner can still also promise a high in-page uniformity of image density. Besides, even on transfer materials having a low smoothness, the toner can achieve transfer uniformity like that on transfer materials having a high smoothness.

Especially where the toner is produced by suspension polymerization, the addition of the polar resin C enhances granulation stability to make the toner particles take the core-shell structure more easily. Hence, this leads the toner to achieve both running performance and fixing performance and be more improved in storage stability.

As a monomer for producing the polar resin C, it may include styrene sulfonic acid, 2-acrylamido-2-methylpropanesulfonic acid, 2-methacrylamido-2-methylpropanesulfonic acid, vinylsulfonic acid and methacrylsulfonic acid. Also usable are compounds in which the sulfonic acid group any of these monomers have has been made into a salt or esterified with a methyl group or an ethyl group.

The polar resin C may be a homopolymer of the above monomer, but may be a copolymer of the above monomer with any other monomer. Such other monomer which forms a copolymer together with the above monomer may be a vinyl type polymerizable monomer, and a monofunctional polymerizable monomer or polyfunctional polymerizable monomer may be used.

The polar resin C may preferably be one having a glass transition point Tg (C) of from 70° C. to 90° C. Also, the glass transition points of the polar resin A, polar resin B and polar resin C may have a relationship of $Tg(B) \leq Tg(C) < Tg(A)$.

The polar resin C may preferably be contained in an amount of from 0.01 part by mass to 5.0 parts by mass, and much preferably from 0.1 part by mass to 3.0 parts by mass, based on 100 parts by mass of the binder resin.

In the present invention, in order to enhance the mechanical strength of the toner while maintaining the low Tg of the cores in the toner particles, a cross-linking agent may also be used when the binder resin is synthesized.

As the cross-linking agent, divinylbenzene is preferred. Cross-linking agents as shown below may also be used. As a bifunctional cross-linking agent, it may include the following: Bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethylene glycol #200 diacrylate, polyethylene glycol #400 diacrylate, polyethylene glycol #600 diacrylate, dipropylene glycol diacrylate, polypropylene glycol diacrylate, polyester type diacrylates (MANDA; available from Nippon Kayaku Co., Ltd.), and the above diacrylates each acrylate moiety of which has been replaced with methacrylate.

As a polyfunctional cross-linking agent, it may include the following: Pentaerythritol triacrylate, trimethylolethane triacrylate, trimethylolpropane triacrylate, tetramethylolmethane tetraacrylate, oligoester acrylate, and methacrylates of these, and also 2,2-bis(4-methacryloxy-polyethoxyphenyl)propane, diallyl phthalate, triallyl cyanurate, triallyl isocyanurate and triallyl trimellitate.

Any of these cross-linking agents may preferably be added in an amount of from 0.001 part by mass to 1.0000 parts by mass, and much preferably from 0.010 part by mass to 0.500 parts by mass, based on 100 parts by mass of the polymerizable monomer.

As the polymerization initiator, it may include the following: Azo or diazo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide and tert-butyl-peroxypivarate.

Any of these polymerization initiators may commonly be added in an amount of from 3 parts by mass to 20 parts by mass based 100 parts by mass of the polymerizable monomer, which may vary depending on the intended degree of polymerization. The polymerization initiator may a little differ in type depending on methods for polymerization, and may be used alone or in the form of a mixture, making reference to its 10-hour half-life period temperature.

The colorant used in the present invention may include the following organic pigments or dyes and inorganic pigments.

As cyan colorants, copper phthalocyanine compounds and derivatives thereof, anthraquinone compounds and basic dye lake compounds may be used. Stated specifically, they may include the following: C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62 and C.I. Pigment Blue 66.

As magenta colorants, they may include the following: Condensation azo compounds, diketopyrrolopyrrole compounds, anthraquinone compounds, quinacridone compounds, basic-dye lake compounds, naphthol compounds, benzimidazolone compounds, thioindigo compounds and perylene compounds. Stated specifically, they may include the following: C.I. Pigment Red 2, C.I. Pigment Red 3, C.I. Pigment Red 5, C.I. Pigment Red 6, C.I. Pigment Red 7, C.I. Pigment Red 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221 and C.I. Pigment Red 254.

As yellow colorants, compounds typified by condensation azo compounds, isoindolinone compounds, anthraquinone compounds, azo metal complexes, methine compounds and allylamide compounds. Stated specifically, they may include the following: C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191 and C.I. Pigment Yellow 194.

As black colorants, carbon black and colorants toned in black by the use of yellow, magenta and cyan colorants shown above may be used.

Any of these colorants may be used alone, in the form of a mixture, or further in the state of a solid solution. The colorant used in the toner of the present invention is selected taking account of hue angle, chroma, brightness, light-fastness, transparency on OHP films and dispersibility in toner particles.

The colorant may be used in its addition in an amount of from 1 part by mass to 20 parts by mass based on 100 parts by mass of the binder resin.

In the present invention, when the toner particles are obtained by polymerization, attention must be paid to polymerization inhibitory action or aqueous-phase transfer properties inherent in the colorant. Accordingly, the colorant may preferably be subjected to surface modification such as hydrophobic treatment with a material free from any polymerization inhibition. In particular, most dye type colorants and carbon black have the polymerization inhibitory action and hence care must be taken when used. A method for controlling such polymerization inhibitory action of the dye type colorants may include a method in which the polymerizable monomer is beforehand polymerized in the presence of any of these dyes. The resultant colored polymer may be added to the polymerizable monomer composition. With regard to the carbon black, besides the same treatment as that on the dye type colorants, it may also be treated with a material capable of reacting with surface functional groups of the carbon black, as exemplified by polyorganosiloxane.

In the toner of the present invention, a charge control agent may optionally be used in the state it is mixed in the toner particles. Such mixing with a charge control agent enables stabilization of charge characteristics and control of optimum triboelectric charge quantity in conformity with the development system.

As the charge control agent, any known charge control agent may be used. In particular, charge control agents which can give speedy triboelectric charging and also can maintain a constant triboelectric charge quantity stably are preferred. Further, it is particularly preferable to use charge control agents having a low polymerization inhibitory action and being substantially free of any solubilizate to any aqueous dispersion medium.

The charge control agent may include, as charge control agents capable of controlling the toner to be negatively chargeable, monoazo metal compounds, acetylacetone metal compounds, aromatic hydroxycarboxylic acids, aromatic dicarboxylic acids, and hydroxycarboxylic acid and dicarboxylic acid type metal compounds. Besides, it may also include aromatic mono- and polycarboxylic acid anhydrides or esters thereof, and phenolic derivatives such as bisphenol. It may further include urea derivatives, metal-containing naphthoic acid compounds, boron compounds, quaternary ammonium salts, carixarene, and resin type charge control agents.

Meanwhile, it may also include, as charge control agents capable of controlling the toner to be positively chargeable, the following: Nigrosine and Nigrosine-modified products, modified with a fatty acid metal salt; guanidine compounds; imidazole compounds; quaternary ammonium salts such as tributylbenzylammonium 1-hydroxy-4-naphthosulfonate and tetrabutylammonium teterafluoroborate, and analogues of these, including onium salts such as phosphonium salts, and lake pigments of these; triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; and resin type charge control agents.

Any of these charge control agents may be used alone or in combination of two or more types.

Of these charge control agents, metal-containing salicylic acid compounds are preferred. In particular, as their metal, aluminum or zirconium is preferred. As the most preferred control agent, it is a 3,5-di-tert-butylsalicylic acid aluminum compound.

The charge control agents may preferably be mixed in an amount of from 0.01 part by mass to 20.00 parts by mass, and much preferably from 0.50 part by mass to 10.00 parts by mass, based on 100 parts by mass of the binder resin.

In the toner of the present invention, an inorganic fine powder may preferably be externally added to the toner particles (toner base particles) for the purpose of improving fluidity. Such an inorganic fine powder may include fine silica powder. The fine silica powder may preferably have a number average primary particle diameter of from 4 nm to 80 nm. Inasmuch as it has number average primary particle diameter within this range, the toner is improved in fluidity and also the toner can have a good storage stability. As to the number average primary particle diameter of the inorganic fine powder, particle diameters of 100 particles in the visual field under observation on a scanning electron microscope are measured to determine the average particle diameter.

As the inorganic fine powder, fine powder of titanium oxide, aluminum oxide or double oxide of these may also be used in combination with the fine silica powder. The titanium oxide is preferred as the inorganic fine powder used in combination.

The fine silica powder may include both fine powders of what is called dry-process silica or fumed silica produced by vapor phase oxidation of a silicon halide and what is called wet-process silica produced from water glass. As the silica, the dry-process silica is preferred, as having less silanol groups on the particle surfaces and interiors of silica particles and leaving less production residues such as $Na_2O$ and $SO_3^{2-}$.

In the dry-process silica, it is also possible to use, e.g., in its production step, other metal halide such as aluminum chloride or titanium chloride together with the silicon halide to obtain a composite fine powder of silica with other metal oxide.

The fine silica powder and so forth may preferably be those having been subjected to hydrophobic treatment. As a treating agent therefor, it may include the following: Unmodified silicone varnish, modified silicone varnish of various types, unmodified silicone oil, modified silicone oil of various types, silane compounds, silane coupling agents, other organosilicon compounds, and organotitanium compounds. Any of these treating agents may be used alone or in combination. In particular, it is preferable to use silicone oil as the treating agent.

The suspension polymerization process in the present invention is described below.

First, a polymerizable monomer for forming the binder resin, a colorant, a wax component and optionally any other additives are uniformly dissolved or dispersed by means of a dispersion machine such as a homogenizer, a ball mill, a colloid mill or an ultrasonic dispersion machine. In particular, after going through a dispersion step in which at least the colorant is dispersed in the polymerizable monomer to obtain a colorant-containing monomer, it is preferable to carry out a mixing control step in which the colorant-containing monomer and a polar resin-containing monomer are mixed. To the mixture obtained, a polymerization initiator is dissolved to prepare a polymerizable monomer composition.

Next, the polymerizable monomer composition obtained is suspended in an aqueous medium containing a dispersant to carry out granulation to form particles of the polymerizable monomer composition. Then, the polymerizable monomers contained in the particles of the polymerizable monomer composition are polymerized to obtain the toner particles. The polymerization initiator may be added simultaneously when other additives are added to the polymerizable monomers, or may be mixed immediately before the polymerizable monomer composition is suspended in the aqueous medium. Also, a polymerization initiator having been dissolved in the polymerizable monomer or in a solvent may be added immediately after the granulation and before the polymerization reaction is initiated.

As the dispersant, any known inorganic and organic dispersants may be used. The inorganic dispersant may include the following: Tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica and alumina.

Meanwhile, the organic dispersant may include the following: Polyvinyl alcohol, gelatin, methyl cellulose, methyl hydroxypropyl cellulose, ethyl cellulose, carboxymethyl cellulose sodium salt, and starch.

Commercially available nonionic, anionic or cationic surface active agents may also be used as the dispersant. Such a surface active agent may include the following: Sodium dodecyl sulfate, sodium tetradecyl sulfate, sodium pentadecyl sulfate, sodium octyl sulfate, sodium oleate, sodium laurate, potassium stearate, and calcium oleate.

As the dispersant, an inorganic sparingly water-soluble dispersant is preferred, and yet it is preferable to use a sparingly water-soluble dispersant that is soluble in acid. Where an aqueous dispersion medium is prepared using the sparingly water-soluble dispersant, such a dispersant may preferably be used in an amount of from 0.2 part by mass to 2.0 parts by mass based on 100 parts by mass of the polymerizable monomer. The aqueous dispersion medium may also preferably be prepared with use of water in an amount of from 300 parts by mass to 3,000 parts by mass based on 100 parts by mass of the polymerizable monomer composition.

Where the aqueous dispersion medium in which the sparingly water-soluble inorganic dispersant has been dispersed as described above is prepared, it may be dispersed using a commercially available dispersant as it is. Also, in order to obtain particles of the dispersant which have a fine and uniform particle size, the sparingly water-soluble inorganic dispersant may be formed in a liquid medium such as water under high-speed stirring to prepare the aqueous dispersion medium. For example, where tricalcium phosphate is used as the dispersant, an aqueous sodium phosphate solution and an aqueous calcium chloride solution may be mixed under high-speed stirring to form fine particles of the tricalcium phosphate.

A stirring apparatus utilizing a high-speed shear force, used preferably in the above mixing control step, is described below with reference to the drawings, which is a stirring apparatus (dispersion machine) having a stirring blade which is rotatable at a high speed and a stirring framework having a stirring space which is formed by a screening member provided around the stirring blade and rotatable at a high speed in the direction opposite to the stirring blade.

Figure 3B:
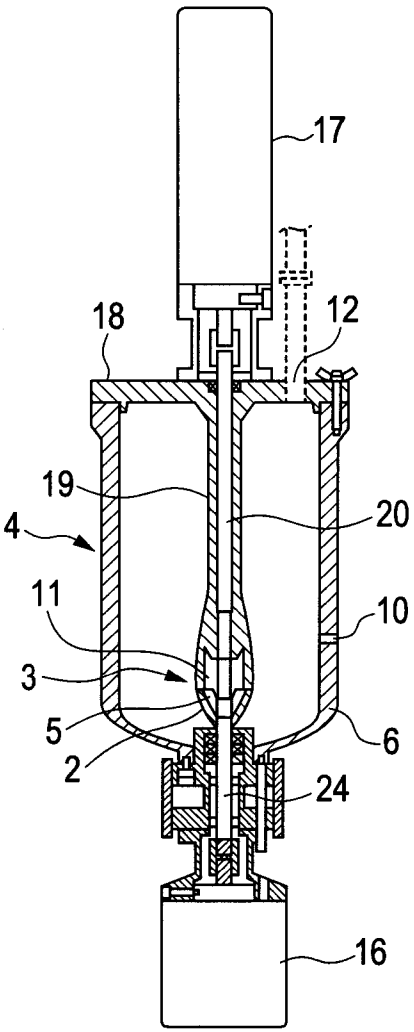
FIG. 3B is a schematic enlarged sectional view of the stirring apparatus shown in FIG. 3A.
Figure 3A:
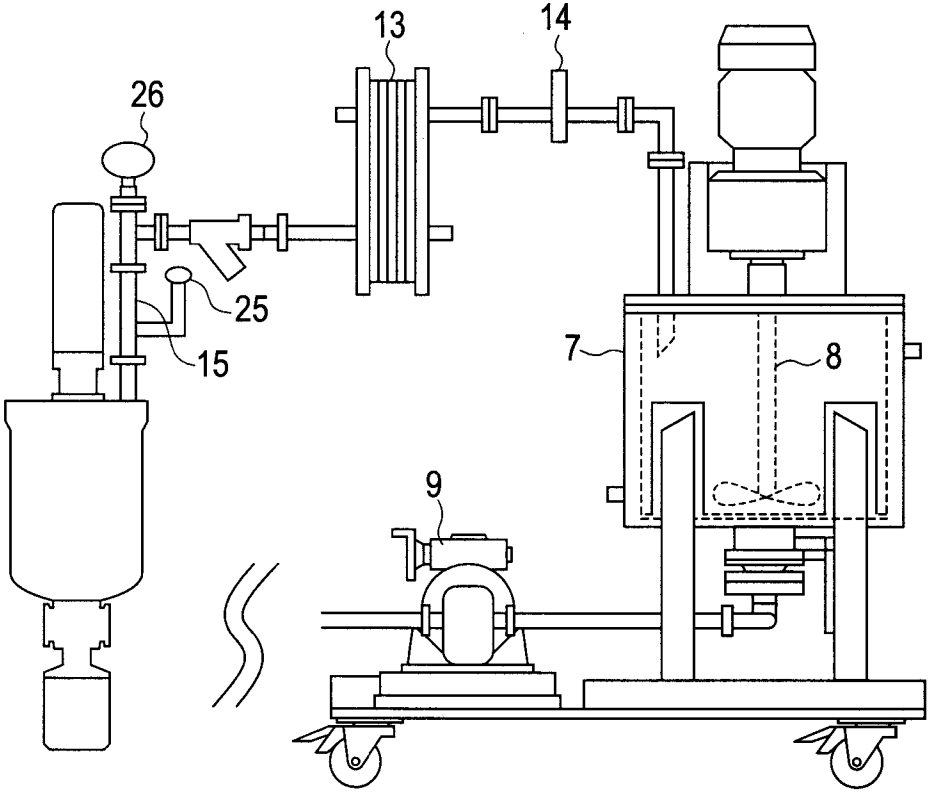
FIG. 3A is a schematic system view of an embodiment in which a stirring apparatus utilizing a high-speed shear force is incorporated in a circulation line.
Figure 4A:
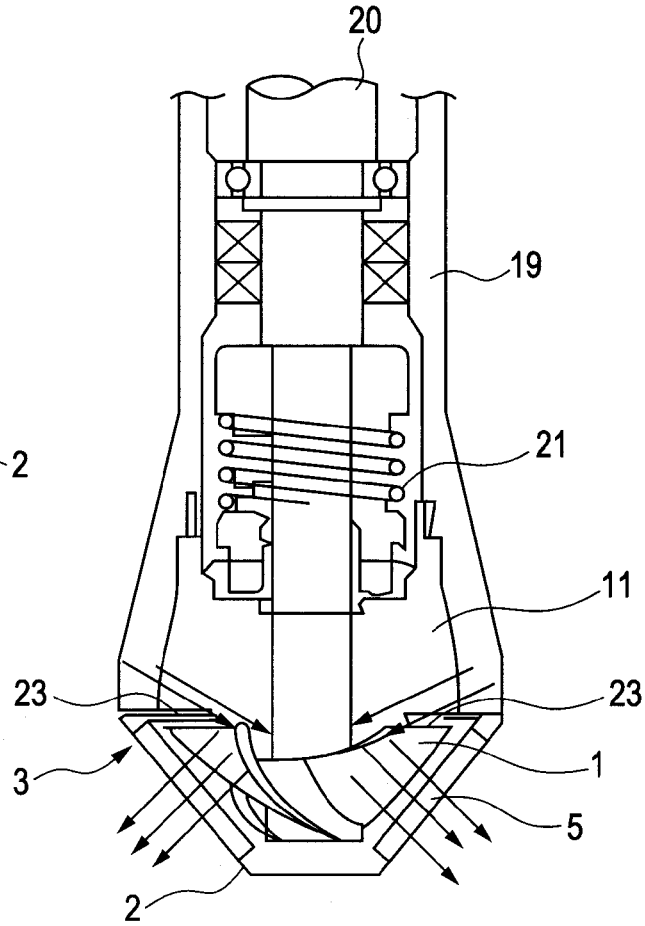
FIG. 4A is a schematic sectional view in the vertical direction of an embodiment of the main part of the stirring apparatus shown in FIG. 3A, having a stirring framework.
Figure 4B:
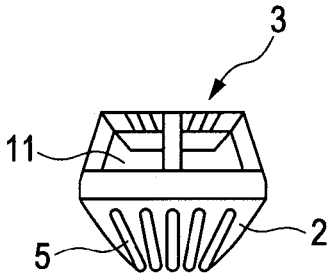
FIG. 4B is a schematic external view of the stirring framework shown in FIG. 4A.
Figure 5:
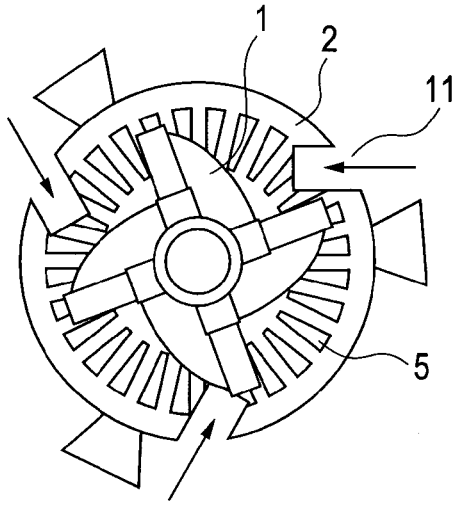
FIG. 5 is a sectional view in the horizontal direction, showing the disposition of component parts in the stirring framework shown in FIGS. 4A and 4B.

An embodiment of the stirring apparatus preferably used when the toner of the present invention is produced is described here. A dispersion system in which the stirring apparatus is incorporated in a circulation line, a cross section of a stirring mechanism having the stirring framework, and the disposition of component parts in the stirring framework are shown in FIGS. 3A, 4A and 5, respectively. FIG. 3B is an enlarged sectional view of the stirring apparatus shown in FIG. 3A, and FIG. 4B is an external view of the stirring framework shown in FIG. 4A.

Re FIGS. 3A and 3B dispersion system:

The colorant-containing monomer and the polar resin-containing monomer are put into a holding tank 7 and thereafter mixed by means of a stirring-blade unit 8 provided in the holding tank 7, to prepare the polymerizable monomer composition, which is then fed by means of a circulating pump 9 into a dispersion container 4 of a dispersion machine through a dispersion container inlet 10 and introduced into a stirring framework 3 through its sucking inlet 11.

The stirring framework 3 is so supported with a supporting cylinder 19 as to be positioned at a lower part of the dispersion container 4 and also has, beneath the sucking inlet 11, a screening member 2 which is fastened to a lower-part rotating shaft 24 and is rotatable by a lower-part motor 16. The stirring framework 3 is also so positioned as to surround an upper-part rotating shaft 20 at its lower part which shaft 20 is rotatable in the direction opposite to the rotational direction of the screening member 2 by an upper-part motor 17 and provided coaxially through the supporting cylinder 19. To the upper-part rotating shaft 20, a stirring blade (shown later) is so fastened as to be positioned in the screening member 2 at the lower part (bottom part) of the stirring framework 3.

Next, the polymerizable monomer composition having been introduced into the stirring framework 3 through its sucking inlet 11 is dispersion-treated by high-speed shear treatment in the stirring space of the stirring framework 3 and then expelled therefrom through its expelling outlet 5. The polymerizable monomer composition having been expelled therefrom is circulated inside the dispersion container 4, and thereafter discharged therefrom through a discharge outlet 12. It is then returned to the holding tank 7 via a heat exchanger 13 and so forth. The polymerizable monomer composition having been returned to the holding tank 7 is again fed into the dispersion container 4, and this circulation is repeated.

The repetition of such circulation through the dispersion machine and the holding tank 7 enables uniform and well efficient dispersion of the polar resin in the polymerizable monomer composition. The part where the polymerizable monomer composition having been dispersed by high-speed shear treatment is again discharged into the holding tank 7 may preferably be positioned within the polymerizable monomer composition held in the holding tank 7. Since the polymerizable monomer composition having been dispersed by high-speed shear treatment is returned to the interior of the polymerizable monomer composition held in the holding tank 7, any gases can be prevented from mixing into it. Such mixing of any gases into the polymerizable monomer composition is not preferable because the occurrence of cavitation may be caused with ease at the time of the high-speed shear treatment in the stirring space of the stirring framework 3. The heat exchanger 13 need not necessarily be provided on the circulation line, and a coil type heat exchange line may be placed in the dispersion container 4.

The flow rate for treatment is measured with a flow meter 14 placed in the course of circulation. Back pressure may also be applied by means of a pressure control valve 15. Such application of back pressure enables the cavitation to be kept from coming to occur because of the rotation of the stirring blade 1 and screening member 2, so that the shear force can much more be applied to the fluid to be treated. This enables the pigment to be re-dispersed in a good efficiency in the polymerizable monomer composition. The back pressure may particularly preferably be within the range of from 50 kPa to 150 kPa. In FIG. 3A, reference numeral 25 denotes a pressure gauge; and 26, a thermometer. In FIG. 3B, reference numeral 18 denotes a cover member.

Re FIGS. 4A and 4B stirring apparatus:

The polymerizable monomer composition having been put into the dispersion container 4 is introduced into the stirring framework 3, which has the sucking inlet 11 and the screening member 2 internally provided with a stirring blade 1 and having the expelling outlet 5 and forming the stirring space. The upper-part rotating shaft 20 extending through the center of the stirring framework 3 is mechanically sealed with a mechanical seal 21, and the stirring framework 3 has a partition 23 which divides it into its upper part having the sucking inlet 11 and its lower part stirring space defined by the screening member 2, leaving a fluid flow path around the upper-part rotating shaft 20.

The stirring blade 1 is rotated at a high speed in the stirring space of the stirring framework 3, whereby the polymerizable monomer composition undergoes shear force in a very small gap between the inner wall of the screening member 2 and the edges of the stirring blade 1, so that the colorant and polar resin contained in the polymerizable monomer composition are well dispersed and dissolved. The polymerizable monomer composition thus dispersion-treated is expelled through the expelling outlet 5 and circulated into the dispersion container 4. In FIG. 4A, inward obliquely downward arrows and outward obliquely downward arrows show the directions in which the polymerizable monomer composition is sucked into and expelled out of the stirring space.

Then, the screening member 2 of the stirring framework 3 is so designed as to be rotated in the direction opposite to the rotational direction of the stirring blade 1, and hence the number of relative revolutions of the both can be made larger, so that the shear force applied to the materials to be treated can be made higher. This enables the colorant and the polar resin to be more highly dispersed and dissolved than those in any other conventional stirring apparatus. As the result, this facilitates production of the toner having the values of physical properties defined in the present invention in the microcompression test.

Further, since the screening member 2 having the expelling outlet 5 in the stirring framework 3 is rotated in the direction opposite to the rotational direction of the stirring blade 1, the positions at which the fluid is expelled therefrom change with such rotation, so that the fluid polymerizable monomer composition can well be circulated in the dispersion container 4. Also, the flow of this circulation is joined with the flow of expelling that is produced by the rotation of the stirring blade 1 that is rotated leaving a vary small gap between it and the expelling outlet 5, and hence a much faster flow of expelling can be produced, and this much more promotes the circulation in the whole dispersion container 4.

Still further, the stirring framework 3 is so designed that, in its interior, the sucking inlet 11 is provided right above the stirring blade 1. This enables the polymerizable monomer composition to be introduced into the stirring framework 3 through the sucking inlet 11 and immediately thereafter, in the stirring space, undergo the high-speed shear by the action of the stirring blade 1 and screening member 2 that are high-speed rotated in the directions opposite to each other, to pass through the expelling outlet 5 from the inside of the screening member 2 of the stirring framework 3. That is, the polymerizable monomer composition can be kept from being returned into the holding tank 7 without passing through the expelling outlet 5 (i.e., short passing) without undergoing any high-speed shear treatment. This can make the dispersion time shorter.

In addition, the dispersion container 4 has a jacket structure, and a cooling medium may be flowed through the interior of a jacket 6. This can make the polymerizable monomer composition lower in temperature having become higher because of any shear in the dispersion container 4.

In order to carry out the dispersion of the polar resin in the polymerizable monomer composition in a good efficiency, the peripheral speed of the stirring blade 1 as represented by A (m/s) and the peripheral speed of the screening member 2 as represented by B (m/s) may preferably be within the ranges of $25 \leq A \leq 40$ and $(A-10) \leq B \leq (A+10)$.

The higher the peripheral speed of the stirring blade 1 is, the larger the shear force applied to the polymerizable monomer composition becomes and the more the dispersion and dissolution efficiency for the colorant and polar resin is improved. Studies made by the present inventors have revealed that the shear force is insufficient and the dispersion and dissolution of the colorant and polar resin is insufficient undesirably if the value of A is less than 25.

In addition, in a polymerizable monomer system that is commonly a solvent system, the cavitation may less occur than in an aqueous system, but the cavitation may abruptly greatly occur if the value of B is more than 40, to lower the dispersion and dissolution efficiency and cause damage in the screening member 2 because of erosion. This is undesirable in view of operation.

Like the stirring blade 1, the higher the peripheral speed of the screening member 2 is, the larger the shear force applied to the polymerizable monomer composition the screening member 2 becomes and the more the dispersion and dissolution efficiency for the colorant and polar resin is improved. If, however, the peripheral speed B (m/s) of the screening member 2 is relatively smaller by 10 or more as compared with the peripheral speed A (m/s) of the stirring blade 1, such a case is undesirable because the shear force may come insufficient that acts between the stirring blade 1 and the screening member 2 rotated in the opposite direction, through the very small gap between the former's blade edges and the latter's inner wall.

Meanwhile, as the stirring blade 1 is rotated, the polymerizable monomer composition is expelled from the stirring blade 1 toward the expelling outlet 5 of the screening member 2 and further expelled out of the stirring space from the expelling outlet 5 in the form of flows under high pressure. The pressure, resistance and shear force that are substantially equally produced on the polymerizable monomer composition becomes larger with an increase in peripheral speed of the screening member 2, and at the same time the amount of the polymerizable monomer composition expelled from the screening member 2 through its expelling outlet 5 comes to decrease. Then, if the peripheral speed B (m/s) of the screening member 2 is relatively larger by 10 or more as compared with the peripheral speed A (m/s) of the stirring blade 1, the amount of the polymerizable monomer composition expelled from the screening member 2 through its expelling outlet 5 may greatly decrease to cause the short passing without passing through the expelling outlet 5, resulting in an increase in proportion of the polymerizable monomer composition discharged out of the stirring space. Hence, if it is larger by 10 or more, the short passing may increase to lower the dispersion and dissolution efficiency and decrease circulation flows inside the dispersion container 4 to cause in-tank non-uniformity, undesirably.

As the dispersion machine described above, CLEAMIX W-Motion (manufactured by $M_{TECHNIQUE}$ Co., Ltd.) may preferably be used, for example.

Figure 6:
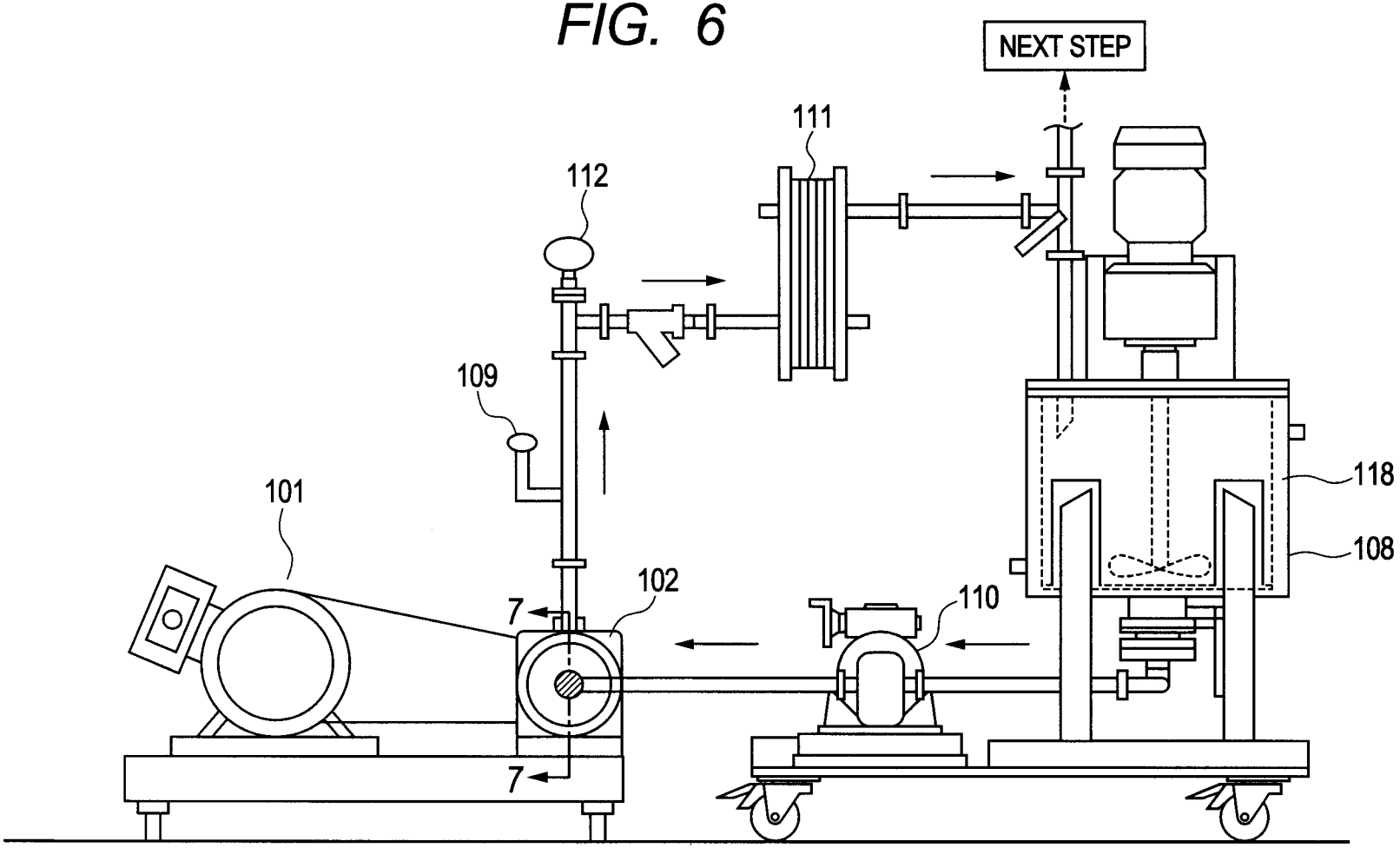
FIG. 6 is a schematic system view where a mixing apparatus having a rotor and a stator is incorporated in a circulation line.

Another embodiment of the stirring apparatus preferably used when the toner of the present invention is produced is described next. A system in which a mixing apparatus having a rotor and a stator is incorporated in a circulation line is shown in FIG. 6. A cross section of the mixing apparatus at its part along the line 7-7 in FIG. 6 is shown in FIG. 7.

In what is shown in FIG. 6, the colorant-containing monomer in which at least the colorant has been dispersed in the polymerizable monomer by the dispersion step and the polar resin-containing monomer in which at least the polar resin has been dissolved in the polymerizable monomer by the dissolution step are put into a holding tank 108 to make up a mixing control solution. The mixing control solution held therein is fed into a mixing apparatus 101 through its inlet via a circulating pump 110. In the mixing apparatus 101, a rotor 125 and a stator 121 (see FIG. 7) are provided in its casing 102, and as shown in FIG. 7 the mixing control solution is fed thereinto through a feed pipe 129 and passes through a shear gap 126 formed between the rotor 125 and the stator 121, and is expelled therefrom in the centrifugal direction. The rotor 125 is set fastened to and rotated by a rotating shaft 130. When the mixing control solution passes through the interior of the casing 102, the mixing control solution is vigorously mixed by compression produced in the centrifugal direction because of any slip-off of the shear gap 126 between the rotor 125 and the stator 121, by compression produced when the solution is expelled therefrom, and by impact produced by the shear acting between the rotor 125 and the stator 121.

Figure 7:
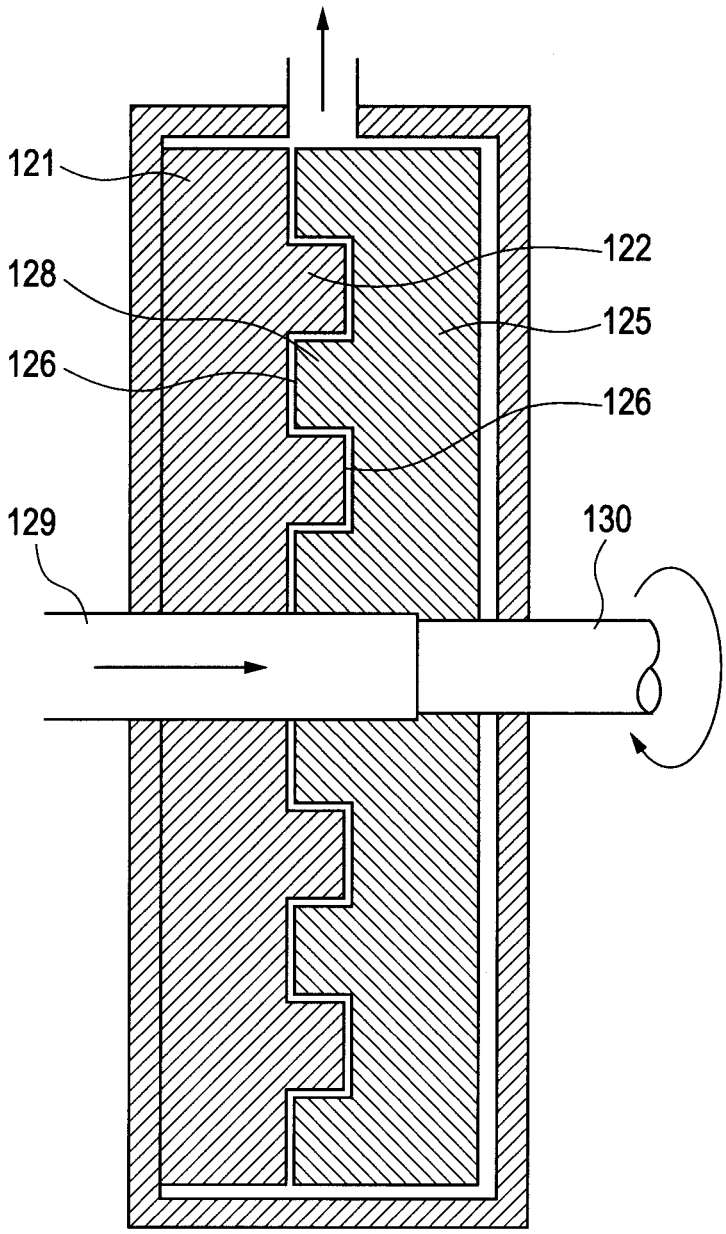
FIG. 7 is a schematic sectional view of the mixing apparatus at its part along the line 7-7 in FIG. 6.

As sectionally shown in FIG. 7, the rotor 125 and the stator 121 are each so shaped as to have such a shape that ring-shaped projections 128 and 122, respectively, having a plurality of shear planes and faces are formed multiply in the form of concentric circles, and may preferably be coaxially face to face placed in such a way that the both engage with each other leaving a constant and very small distance between them. Inasmuch as the rotor 125 and the stator 121 are so shaped as to engage with each other, the short passing may less occur and the mixing control solution can sufficiently be dispersed. Also, inasmuch as the ring-shaped projections of the rotor 125 and stator 121 are multiply present in the form of concentric circles, the mixing control solution undergoes much shear and impact when it moves in the centrifugal direction, and hence the polar resin can be dispersed at a much higher level.

The holding tank 108 has a jacket 118 structure, and hence the solution to be treated can be cooled or heated. This apparatus enables the colorant and the polar resin to be more highly dispersed and dissolved than those in any other conventional stirring apparatus. As the result, this facilitates production of the toner having the values of physical properties defined in the present invention in the micro-compression test. In FIG. 6, reference numeral 109 denotes a pressure gauge; 112, a thermometer; and 111, a heat exchanger.

The peripheral speeds of the rotor and stator are the peripheral speeds at maximum diameters of the rotor and stator. Where the peripheral speed of the rotor is represented by G(m/s), it is preferable for the rotor to be rotated at $20 \leq G \leq 60$ to mix the mixing control solution. As long as the rotor is rotated at $20 \leq G \leq 60$, the compression produced on the mixing control solution in the centrifugal direction because of any slip-off of the shear gap 126 between the rotor and the stator, the compression produced when the solution is expelled therefrom and the impact produced by the shear acting between the rotor and the stator can be so higher as to achieve high-level dispersion and dissolution of the colorant and polar resin. This enables the colorant and polar resin to be brought into a state of more uniform dispersion and dissolution than ever.

As the mixing apparatus described above, CAVITRON (manufactured by Eurotec, Ltd.) may preferably be used, for example.

Figure 8:
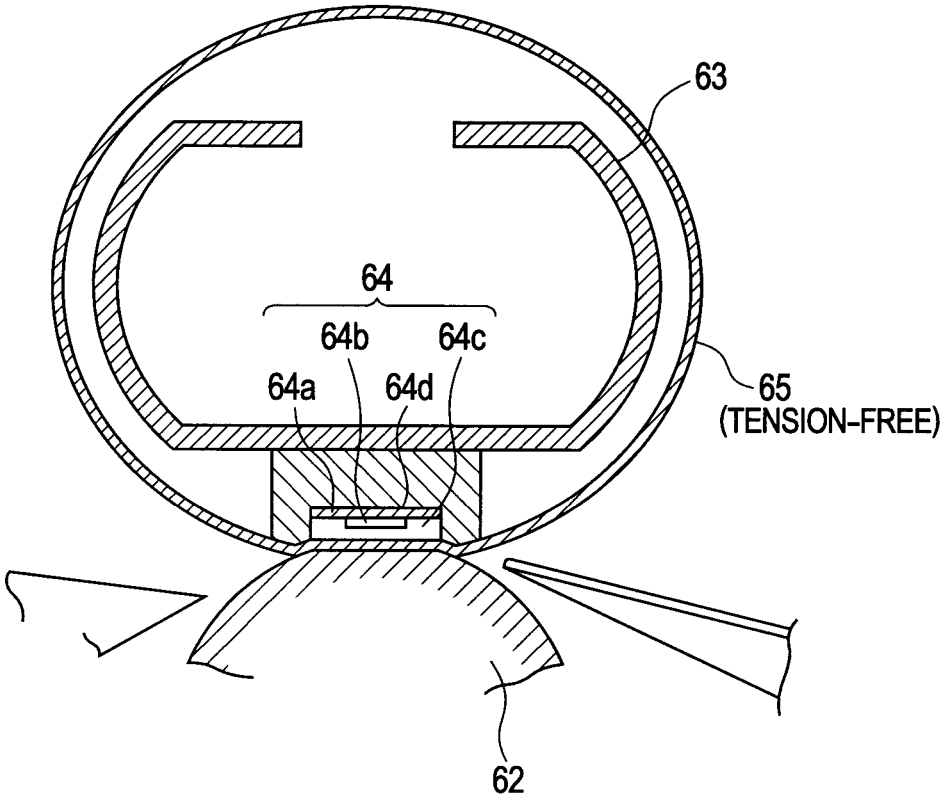
FIG. 8 is a schematic structural view of a fixing assembly.

A fixing assembly in which a heat-resistant film is heated with use of a heating element to fix toner images is shown in FIG. 8. This fixing assembly has a structure that provides a state in which any tension is not applied to the heat-resistant film (i.e., a tension-free type). The toner of the present invention especially brings out its effect in an image forming method which performs fixing by using such a light-load fixing assembly.

In the above fixing assembly, the heating element is one having a small heat capacity and having a linear or planar heating part, which heating part may preferably have a maximum temperature of from 100° C. or more to 300° C. or less. The heat-resistant film may preferably be a heat-resistant sheet having a thickness of from 1 μm or more to 100 μm or less. What may be used as the heat-resistant sheet is a polymer sheet such as a polyester, PET (polyethylene terephthalate), PFA (tetrafluoroethylene-perfluoroalkyl vinyl ether copolymer), PTFE (polytetrafluoroethylene), polyimide or polyamide sheet, having a high heat resistance, as well as a metal sheet such as an aluminum sheet, or a laminated sheet constituted of the metal sheet and the polymer sheet.

Reference numeral 64 denotes a low heat capacitance linear heating medium, which consists of a heater substrate 64*a*, an electrification heat-generating resistor (heating element) 64*b*, a surface protective layer 64*c*, a temperature detector 64*d* and so forth. The heater substrate 64*a* is a member having heat resistance, insulation properties, low heat capacitance and high thermal conductivity, as exemplified by an alumina substrate of 1 mm in thickness, 10 mm in width and 240 mm in length.

The heating element 64*b* is an element formed by coating an electrically resistant material in a linear or thin-belt form of about 10 μm in thickness and 1 to 3 mm in width on the heater substrate 64*a* along its long dimension and substantially at the middle of its bottom surface (the side facing a heat-resistant film 65), and further coating thereon heat-resistant glass in a thickness of about 10 μm as the surface protective layer 64*c*. As the electrically resistant material, Ag—Pd (silver-palladium), $Ta_2N$, $RuO_2$ or the like may be used, for example. Also, as a method for coating the electrically resistant material, a screen printing method or the like may be used.

The temperature detector 64*d* is, e.g., a low heat capacitance temperature-measuring resistor such as a Pt film formed by screen printing or the like substantially at the middle of the top surface (the side opposite to the side on which the heating element 64*b* is provided) of the heater substrate 64*a*. A low heat capacitance thermistor may also be used.

The heating medium 64 causes the heating element 64*b*, which is linear or planar, to generate heat substantially over its whole length by electrifying the heating element 64*b* at a given timing in accordance with image formation start signals. It is electrified at AC 100 V, and electric power to be supplied is controlled by controlling the phase angle of its electrification by means of an electrification control circuit (not shown) including a triac, in accordance with the temperature detected by the temperature detector 64*d*.

In the heating medium 64, the heater substrate 64*a*, the heating element 64*b* and the surface protective layer 64*c* have so small heat capacitance that the surface of the heating medium 64 may rapidly be heated to the desired fixing temperature (e.g., 140° C. to 200° C.) upon electrification to the heating element 64*b*. Then, the heat-resistant film 65 is kept in contact with this heating medium 64.

In order to make the heat capacity small so as to improve quick-start performance, a single layer, or a composite layer, of from 20 μm or more to 100 μm or less in total thickness and having heat resistance, releasability, strength, durability and durability may be used as the heat-resistant film 65. For example, it is a single-layer film of polyimide, polyether imide (PEI), polyether sulfone (PES), tetrafluoroethylene-perfluoroalkyl vinyl ether copolymer resin (PFA), polyether ether ketone (PEEK) or polyparabanic acid (PPA), or a composite-layer film of, e.g., a polyimide film of 20 μm in thickness and, provided in a thickness of 10 μm at least on its side coming into contact with toner images, a release coat layer of fluorine resin such as PTFE (tetrafluoroethylene resin), PAF or FEP or a silicone resin, to which a conductive material (such as carbon black, graphite or conductive whisker) has further been added.

A rotary member, support roller 62 is made of, e.g., a rubber elastic material having good releasability, such as silicone rubber. It is kept in pressure contact with the heating medium 64 through the heat-resistant film 65 to form a nip between them, and moves and drives the heat-resistant film 65 at a stated speed. At the time a recording material sheet as a material to be heated and holding the toner images thereon has been lead to the part between the support roller 62 and the heat-resistant film 65, the support roller 62 brings the recording material sheet into close contact with the surface of the heat-resistant film 65 to press it against the heating medium 64, and moves and drives it together with the heat-resistant film 65. In FIG. 8, reference numeral 63 denotes a support to which the heating medium 64 is fastened.

EXAMPLES

The present invention is described below by giving Examples. In Examples, "part(s)" as so termed refers to "part(s) by mass" in all occurrences.

Example 1

Preparation of Aqueous Dispersion Medium

| | |
|---|---|
| Water | 350.0 parts |
| Trisodium phosphate | 15.0 parts |

A mixture of the above was stirred by means of a high-speed stirring apparatus TK-type homomixer (manufactured by Tokushu Kika Kogyo Co., Ltd.) at a speed of 12,000 rpm, during which the system was retained at 60° C. Next, 9 parts of calcium chloride was added to prepare an aqueous dispersion medium containing fine sparingly water-soluble stabilizer $Ca_3(PO_4)_2$.

Preparation of Polymerizable Monomer Composition 1:

| (Dispersion Step) | |
|---|---|
| Styrene | 30.0 parts |
| C.I. Pigment Blue 15:3 | 5.0 parts |
| Negative charge control agent | 1.0 part |

(Al Compound of 3,5-di-tertiary-butylsalicylic acid)

A mixture of the above was subjected to dispersion by means of an attritor at room temperature for 5 hours to obtain a polymerizable monomer mixture 1. Subsequently, this polymerizable monomer mixture 1 was put into a temperature-controllable stirring tank, and then heated to 60° C. Next,

| | |
|---|---|
| Fischer-Tropsch wax (peak temperature of maximum endothermic peak: 75° C.) | 10.0 parts |
| Divinylbenzene | 0.3 part |

were put into the above stirring tank, where the stirring was further continued for 1 hour to prepare a polymerizable monomer composition 1.

Preparation of Polymerizable Monomer Composition 2:

| (Dissolution Step) | |
|---|---|
| Styrene | 35.0 parts |
| n-Butyl acrylate | 35.0 parts |
| Polar resin A1 (styrene-methacrylic acid-methyl methacrylate-2-hydroxyethyl methacrylate copolymer; Mw: 14,800; Tg: 89° C.; acid value Av: 22 mgKOH/g; hydroxyl value OHv: 8 mgKOH/g) | 20.0 parts |
| Polar resin B1 (polyester resin which is a polycondensation product of propylene oxide modified bisphenol A with terephthalic acid; Mw: 9,500; Tg: 74° C.; acid value Av: 9 mgKOH/g; hydroxyl value OHv: 25 mgKOH/g) | 5.0 parts |
| Polar resin C1 (styrene-2-ethylhexyl acrylate copolymer containing 5% of 2-acrylamido-2-methylpropanesulfonic acid; Tg: 81° C.) | 1.0 part |

A mixture of the above was put into a temperature-controllable stirring tank, and then heated to 60° C. After heating to 60° C., this was stirred for 5 hours to obtain a polymerizable monomer composition 2.

(Mixing Control Step)

The polymerizable monomer composition 2 was heated to 70° C., and the polymerizable monomer composition 1 was mixed into it, followed by stirring for 10 minutes. Thereafter, the mixture formed was slowly cooled to 65° C.

(Granulation/Polymerization Step)

The mixture of the polymerizable monomer compositions 1 and 2 was introduced into the above aqueous dispersion medium. Further, 8.0 parts of a polymerization initiator 2,2'-azobisisobutyronitrile was added to this aqueous dispersion medium, and granulation was carried out for 30 minutes while maintaining the number of revolutions of the stirring apparatus to 12,000 rpm. Thereafter, the mixture in the high-speed stirring apparatus was moved to a propeller stirrer, and its internal temperature was raised to 70° C., where the reaction was carried out for 5 hours with slow stirring. Next, the interior of its container was heated to a temperature of 80° C., which was maintained for 5 hours. Thereafter, this was cooled to obtain a polymer fine particle dispersion.

(Washing/Solid-liquid Separation/Drying Step/External Addition Step)

To the polymer fine particle dispersion obtained, dilute hydrochloric acid was added to adjust its pH to 1.4 to dissolve the stabilizer $Ca_3(PO_4)_2$. Further, the resultant dispersion was filtered, washed and thereafter dried in vacuum at a temperature of 40° C., followed by removal of coarse powder with use of a sieve of 150 μm in mesh opening, and then control of particle diameter to obtain cyan toner particles.

To 100 parts of the cyan toner particles (toner base particles) obtained, 2.0 parts of hydrophobic silica having a specific surface area of 200 $m^2/g$ as measured by the BET method (one having been treated with 10 parts of silicone oil based on 100 parts of silica; average primary particle diameter: 13 nm) was externally added by agitating these by means of HENSCHEL mixer for 10 minutes, to obtain a cyan toner No. 1. Physical properties of this cyan toner No. 1 are shown in Tables 1-1 and 1-2.

In regard to the cyan toner No. 1 obtained, evaluation was made about the following items [1] to [13]. Results of the evaluation are shown in Table 2. The evaluation was likewise made also about toners obtained in Examples 2 to 37 and Comparative Examples 1 to 4.

As an image forming apparatus used in the evaluation, a conversion machine of a commercially available laser printer LBP-5400 (manufactured by CANON INC.). Conversion points of this evaluation machine are as follows:

(1) Gear and software of the main body of the evaluation machine were so changed as to provide a process speed of 190 mm/sec.

(2) As a cartridge used for the evaluation, a cyan cartridge was used. More specifically, a toner was drawn out of a commercially available cartridge, and its interior was cleaned by air blowing. Thereafter, 100 g of the toner produced in this Example was filled therein to make evaluation. Incidentally, as to the other respective yellow, magenta and black stations, product toners were drawn out of these, and yellow, magenta and black cartridges the toner remainder detection mechanisms of which were made inoperable were inserted thereto to make evaluation.

(3) As to its fixing assembly, software was so changed that the heating temperature was controllable at 130° C. to 170° C.

(4) In order to obtain unfixed images, software was so changed that the apparatus was operable even though the fixing assembly was detached.

Under the above conditions, the process cartridge filled with the cyan toner No. 1 was left to stand for 48 hours in a normal-temperature and low-humidity environment (23° C./5% RH). Next, using A4-size CANON Color Laser Copier sheets (basis weight: 81.4 $g/m^2$) and after an image with a print percentage of 0% (solid white) was reproduced on 3,000 sheets, images with a print percentage of 1% having solid black images for density measurement was continuously printed on up to 3,000 sheets. Thereafter, the evaluation was made on items [1] to [9] to make evaluation about developing performance, transfer performance and cleaning performance.

[1] Image Density:

After the image with a print percentage of 0% was printed on 3,000 sheets, the image density of solid black areas of an image on 3,000th sheet was measured to make evaluation. Here, the image density was measured with MACBETH Reflection Densitometer RD918 (manufactured by Gretag Macbeth Ag.) to measure the relative density with respect to an image printed on a white background area with an image density of 0.00 of an original, according to the instructions attached thereto.

A: The image density is 1.40 or more.

B: The image density is 1.35 or more to less than 1.40.

C: The image density is 1.00 or more to less than 1.35.

D: The image density is less than 1.00.

[2] Glossiness:

Subsequent to the item [1], using a A4-size CANON Color Laser Copier sheet (basis weight: 81.4 g/m$^2$), solid black images were reproduced on one sheet. For the solid black images obtained, their mage glossiness at a measurement optical angle of 75 degrees was measured with a gloss meter PG-3G (manufactured by Nippon Denshoku Industries Co., Ltd.) and according to the instructions attached thereto.

A: The mage glossiness is 20 or more.

B: The mage glossiness is 15 or more to less than 20.

C: The mage glossiness is 10 or more to less than 15.

D: The mage glossiness is less than 10.

[3] Image Fog:

Subsequent to the item [1], images with a print percentage of 1% were printed on letter-size sheets of Color Laser Photo Paper, glossy (basis weight: 220 g/m$^2$) in a gloss paper mode (½ speed). Fog density (%) was calculated from the difference between the whiteness of white background areas of printed images and the whiteness of a transfer sheet as measured with REFLECTOMETER MODEL TC-6DS (manufactured by Tokyo Denshoku Co., Ltd.) to make evaluation on image fog. As a filter, an amber filter was used.

A: The fog density is less than 0.5%.

B: The fog density is 0.5% or more to less than 1.0%.

C: The fog density is 1.0% or more to less than 1.5%.

D: The fog density is 1.5% or more.

[4] Rise of Charging:

Of images with a print percentage of 1% which were printed on 3,000 sheets, solid black areas of images with a print percentage of 1% on the 1st sheet to 20th sheet were measured with MACBETH Reflection Densitometer RD918 (manufactured by Gretag Macbeth Ag.). Then, the rise of charging of the toner was evaluated by the number of sheets needed until the image density came to 1.4.

A: The number of sheets needed until the image density came to 1.4 is 5 sheets or less.

B: The number of sheets needed until the image density came to 1.4 is from 6 to 10 sheets.

C: The number of sheets needed until the image density came to 1.4 is from 11 to 20 sheets.

D: The number of sheets needed until the image density came to 1.4 is 21 sheets or more.

[5] Transfer Uniformity:

After images with a print percentage of 1% which were printed on 100 sheets and 3,000 sheets, halftone images (toner laid-on level: about 0.20 mg/cm$^2$) were reproduced on one sheet of FOX RIVER BOND Sheet (basis weight: 90 g/m$^2$) to make evaluation. The image density of halftone image areas was measured with MACBETH Reflection Densitometer RD918 (manufactured by Gretag Macbeth Ag.). The measurement of such halftone image areas was made at arbitrary 10 spots of the halftone images to calculate the difference between the maximum value and the minimum value of the measured values. Visual observation was also made at the same time for the halftone images. The evaluation was made according to the following criteria.

A: The halftone images are uniform under visual observation, and the density difference is less than 0.10.

B: The halftone images are uniform under visual observation, and the density difference is 0.10 or more to less than 0.15.

C: Light vertical lines at a level that they are erasable by image processing are seen under visual observation, and the density difference is 0.10 or more to less than 0.15.

D: Clear vertical lines at a level that they are not erasable by image processing are seen under visual observation, and the density difference is 0.15 or more.

[6] High-Print Image Density Variation:

Subsequent to the item [5], using A4-size CANON Color Laser Copier sheets (basis weight: 81.4 g/m$^2$), solid black images were continuously reproduced on 10 sheets. The rate (%) of change in image density (measured with MACBETH Reflection Densitometer) between that on the 1st sheet and that on the 10th sheet of the images obtained was evaluated to evaluate the stability of image density against high-print images. Judgment criteria are shown below.

A: The rate of change in image density is less than 3%.

B: The rate of change in image density is 3% or more to less than 5%.

C: The rate of change in image density is 5% or more to less than 10%.

D: The rate of change in image density is 10% or more.

[7] Cleaning Performance:

Subsequent to the item [6], using A4-size CANON Color Laser Copier sheets (basis weight: 81.4 g/m$^2$), solid black images were reproduced on one sheet without flowing any transfer electric current. Further, images with a print percentage of 1% were continuously reproduced on 10 sheets. The images obtained were visually examined to evaluate cleaning performance. Judgment criteria are shown below.

A: All the 10 sheets prove good cleaning performance.

B: Light vertical lines at a level that they are erasable by image processing which are caused by any faulty cleaning are seen on the 8th and 9th sheets.

C: Light vertical lines at a level that they are erasable by image processing which are caused by any faulty cleaning are seen on the 5th, 6th and 7th sheets.

D: Vertical lines at a level that they are not erasable by image processing which are caused by any faulty cleaning are seen on the 4th or less sheet.

[8] Contamination in Main Body and/or Cartridge, Caused by Toner Scatter:

Subsequent to the item [7], how the cartridge and/or the main-body interior surrounding the cartridge was/were contaminated with the toner was observed in order to evaluate the balance between charging performance and fluidity of the toner. Judgment criteria are shown below.

A: Any contamination caused by toner scatter is not observed in both the cartridge and the main-body interior surrounding the cartridge.

B: Contamination caused by toner scatter in a trace quantity is observed in the cartridge.

C: Contamination caused by toner scatter is observed in both the cartridge and the main-body interior surrounding the cartridge, but does not affect the images and the attaching and detaching of the cartridge.

D: Both the cartridge and the main-body interior surrounding the cartridge are seriously contaminated because of toner scatter, which is also seen to have adversely affected the images and the attaching and detaching of the cartridge.

[9] Lines in Peripheral Direction:

Subsequent to the item [8], the developing assembly was disassembled, and the surface and end portions of the toner carrying member were visually observed to make evaluation according to the following judgment criteria.

A: Any foreign matter is not seen to have been caught between a toner layer thickness control member and the toner carrying member, and any line in the peripheral direction is also not seen.

B: Foreign matter is somewhat seen to have been caught between the toner carrying member and its toner end seals, but any line in the peripheral direction is not seen.

C: A line or lines in the peripheral direction is/are seen to have come about at end portions of the toner carrying member, and 1 to 4 lines are seen.

D: Lines in the peripheral direction are seen to have come about over the whole region of the toner carrying member, and 5 or more lines are seen.

The process cartridge filled with the toner of this Example was left to stand for 48 hours in a normal-temperature and normal-humidity environment (23° C./50% RH). Thereafter, the evaluation was made on items [10] to [12] concerned with fixing performance.

[10] Blister Test:

Using A4-size CANON Color Laser Copier sheets (basis weight: 81.4 g/m$^2$) as transfer materials, unfixed solid images having a toner laid-on level of 0.9 mg/cm$^2$ were obtained thereon. Then, the fixing assembly of LBP-5400 (manufactured by CANON INC.) was detached out, and the unfixed solid images were fixed by using an external fixing assembly which was made operable even outside the laser beam printer. The external fixing assembly was set at a fixing temperature of 170° C. and a process speed of 190 mm/sec. About the solid images obtained as a result of fixing, the level of blister was visually examined to make evaluation. Here, the blister is a phenomenon that any sufficient amount of heat is not applied to the toner and hence the toner images partly come off at the time of fixing because of a fixing roller.

A: Any blister is not seen to have occurred.

B: The blister is seen to have somewhat occurred.

C: The blister is seen to have occurred, but at a level of no problem.

D: The blister is seen to have seriously occurred.

[11] Folding Test:

Using A4-size CANON Color Laser Copier sheets (basis weight: 81.4 g/m$^2$) as transfer materials, unfixed solid images having a toner laid-on level of 0.9 mg/cm$^2$ were obtained thereon. The unfixed solid images obtained were fixed by using the above external fixing assembly. Here, the fixing temperature was set at 170° C. and the process speed at 190 mm/sec. Thereafter, the transfer materials with fixed images were folded at their image areas, which were folded under such conditions that a load of 4.9 kPa was applied with a flat weight to the part folded, during which the weight was back and forth moved five times. Thereafter, the transfer materials folded were unfolded, and their image areas were back and forth rubbed five times with Silbon paper to which a load of 4.9 kPa was kept applied, where the rate of density decrease of the image density before and after the rubbing was measured. Judgment criteria are shown below.

A: The rate of density decrease is less than 5%.

B: The rate of density decrease is 5% or more to less than 10%.

C: The rate of density decrease is 10% or more to less than 15%.

D: The rate of density decrease is 15% or more.

[12] High-Temperature Anti-Offset Properties:

Using A4-size CANON Color Laser Copier sheets (basis weight: 81.4 g/m$^2$) as transfer materials, unfixed images having a toner laid-on level of 0.5 mg/cm$^2$ in a solid image area of the unfixed images, having the solid image area in the whole area of 5 cm in width from the leading edge of each sheet in the A4-size lengthwise lay and being solid white in the other area were obtained thereon. The unfixed solid images obtained were fixed by using the above external fixing assembly. Here, the fixing temperature was set at temperatures ranging from 170° C. to 200° C. at intervals of 5° C., and the process speed was set at 95 mm/sec, where the level of any offset appearing in the white background area was visually examined. Judgment criteria are shown below.

A: Any offset does not occur.

B: Offset is seen to have faintly occurred at edges of the white background area at a fixing temperature of 200° C.

C: Offset is seen to have occurred in the transfer material whole areas at a fixing temperature of 200° C.

D: Offset is seen to have occurred in the transfer material whole areas at a fixing temperature of 190° C.

[13] Blocking Test:

10 g of the toner was put into a 50 ml plastic cup. This was left to stand for 72 hours in a thermostatic chamber set at a temperature of 53° C., when how the toner stood was visually judged according to the following conditions.

A: Any blocking is seen not to have occurred, and the toner stands substantially like that before its leaving.

B: The toner is seen to have somewhat come to agglomerate, but stands disintegratable by the turning of the plastic cup and does not have any particular problem.

C: The toner is seen to have come to agglomerate, but stands disintegratable upon loosening by hand.

D: The toner is seen to have seriously come to agglomerate.

Example 2

A cyan toner No. 2 was obtained in the same way as in Example 1 except that the polar resin C1 was changed for 1.0 part of a polar resin C2 (styrene-2-ethylhexyl acrylate copolymer containing 5% of 2-acrylamido-2-methylpropanesulfonic acid; Tg: 70° C.). Physical properties of this toner are shown in Tables 1-1 and 1-2, and the results of evaluation in Table 2.

Example 3

A cyan toner No. 3 was obtained in the same way as in Example 1 except that the polar resin C1 was changed for 1.0 part of a polar resin C3 (styrene-2-ethylhexyl acrylate copolymer containing 5% of 2-acrylamido-2-methylpropanesulfonic acid; Tg: 90° C.). Physical properties of this toner are shown in Tables 1-1 and 1-2, and the results of evaluation in Table 2.

Example 4

A cyan toner No. 4 was obtained in the same way as in Example 1 except that the polar resin C1 was changed for 1.0 part of a polar resin C4 (styrene-2-ethylhexyl acrylate copolymer containing 5% of 2-acrylamido-2-methylpropanesulfonic acid; Tg: 68° C.). Physical properties of this toner are shown in Tables 1-1 and 1-2, and the results of evaluation in Table 2.

Example 5

A cyan toner No. 5 was obtained in the same way as in Example 1 except that the polar resin C1 was changed for 1.0 part of a polar resin C5 (styrene-2-ethylhexyl acrylate copolymer containing 5% of 2-acrylamido-2-methylpropanesulfonic acid; Tg: 92° C.). Physical properties of this toner are shown in Tables 1-1 and 1-2, and the results of evaluation in Table 2.

Example 6

A cyan toner No. 6 was obtained in the same way as in Example 1 except that the polar resin C1 was not added. Physical properties of this toner are shown in Tables 1-1 and 1-2, and the results of evaluation in Table 2.

Example 7

A cyan toner No. 7 was obtained in the same way as in Example 6 except that the polar resin A1 was changed for 20.0 parts of a polar resin A2 (styrene-methacrylic acid-methyl methacrylate-2-hydroxyethyl methacrylate copolymer; Mw: 18,500; Tg: 90° C.; acid value Av: 28 mgKOH/g; hydroxyl value OHv: 5 mgKOH/g). Physical properties of this toner are shown in Tables 1-1 and 1-2, and the results of evaluation in Table 2.

Example 8

A cyan toner No. 8 was obtained in the same way as in Example 6 except that the polar resin A1 was changed for 20.0 parts of a polar resin A3 (styrene-methacrylic acid-methyl methacrylate-2-hydroxyethyl methacrylate copolymer; Mw: 26,500; Tg: 95° C.; acid value Av: 5 mgKOH/g; hydroxyl value OHv: 49 mgKOH/g) and that the polar resin B1 was changed for 5.0 parts of a polar resin B2 (polyester resin which is a polycondensation product of propylene oxide modified bisphenol A with isophthalic acid and dodecenyl-succinic acid; Mw: 5,500; Tg: 64° C.; acid value Av: 25 mgKOH/g; hydroxyl value OHv: 35 mgKOH/g). Physical properties of this toner are shown in Tables 1-1 and 1-2, and the results of evaluation in Table 2.

Example 9

A cyan toner No. 9 was obtained in the same way as in Example 6 except that the polar resin A1 was changed for 20.0 parts of a polar resin A4 (styrene-methacrylic acid-methyl methacrylate-2-hydroxyethyl methacrylate copolymer; Mw: 14,800; Tg: 89° C.; acid value Av: 12 mgKOH/g; hydroxyl value OHv: 18 mgKOH/g) and that the polar resin B1 was changed for 5.0 parts of a polar resin B3 (styrene-methacrylic acid-methyl methacrylate-2-hydroxyethyl methacrylate copolymer; Mw: 11,000; Tg: 64° C.; acid value Av: 12 mgKOH/g; hydroxyl value OHv: 21 mgKOH/g). Physical properties of this toner are shown in Tables 1-1 and 1-2, and the results of evaluation in Table 2.

Example 10

A cyan toner No. 10 was obtained in the same way as in Example 6 except that the polar resin A1 was changed for 20.0 parts of a polar resin A5 (styrene-methacrylic acid-methyl methacrylate-2-hydroxyethyl methacrylate copolymer; Mw: 11,400; Tg: 82° C.; acid value Av: 25 mgKOH/g; hydroxyl value OHv: 4 mgKOH/g). Physical properties of this toner are shown in Tables 1-1 and 1-2, and the results of evaluation in Table 2.

Example 11

A cyan toner No. 11 was obtained in the same way as in Example 8 except that the polar resin A3 was changed for 20.0 parts of a polar resin A6 (styrene-methacrylic acid-methyl methacrylate-2-hydroxyethyl methacrylate copolymer; Mw: 28,400; Tg: 97° C.; acid value Av: 8 mgKOH/g; hydroxyl value OHv: 51 mgKOH/g). Physical properties of this toner are shown in Tables 1-1 and 1-2, and the results of evaluation in Table 2.

Example 12

A cyan toner No. 12 was obtained in the same way as in Example 6 except that the polar resin A1 was changed for 20.0 parts of a polar resin A7 (styrene-methacrylic acid-methyl methacrylate-2-hydroxyethyl methacrylate copolymer; Mw: 25,300; Tg: 95° C.; acid value Av: 4 mgKOH/g; hydroxyl value OHv: 40 mgKOH/g) and that the polar resin B1 was changed for 5.0 parts of a polar resin B4 (polyester resin which is a polycondensation product of propylene oxide modified bisphenol A with isophthalic acid; Mw: 7,600; Tg: 67° C.; acid value Av: 20 mgKOH/g; hydroxyl value OHv: 27 mgKOH/g). Physical properties of this toner are shown in Tables 1-1 and 1-2, and the results of evaluation in Table 2.

Example 13

A cyan toner No. 13 was obtained in the same way as in Example 12 except that the polar resin A7 was changed for 20.0 parts of a polar resin A8 (styrene-methacrylic acid-methyl methacrylate-2-hydroxyethyl methacrylate copolymer; Mw: 23,000; Tg: 94° C.; acid value Av: 31 mgKOH/g; hydroxyl value OHv: 8 mgKOH/g). Physical properties of this toner are shown in Tables 1-1 and 1-2, and the results of evaluation in Table 2.

Example 14

A cyan toner No. 14 was obtained in the same way as in Example 6 except that the polar resin A1 was changed for 20.0 parts of a polar resin A9 (styrene-methacrylic acid-methyl methacrylate copolymer; Mw: 15,300; Tg: 88° C.; acid value Av: 10 mgKOH/g). Physical properties of this toner are shown in Tables 1-1 and 1-2, and the results of evaluation in Table 2.

Example 15

A cyan toner No. 15 was obtained in the same way as in Example 14 except that the polar resin B1 was changed for 5.0 parts of a polar resin B5 (polyester resin which is a polycondensation product of propylene oxide modified bisphenol A with terephthalic acid and adipic acid; Mw: 9,000; Tg: 61° C.; acid value Av: 9 mgKOH/g; hydroxyl value OHv: 17 mgKOH/g). Physical properties of this toner are shown in Tables 1-1 and 1-2, and the results of evaluation in Table 2.

Example 16

A cyan toner No. 16 was obtained in the same way as in Example 15 except that the polar resin B5 was changed for 5.0 parts of a polar resin B6 (polyester resin which is a polycondensation product of propylene oxide modified bisphenol A with terephthalic acid; Mw: 11,900; Tg: 78° C.; acid value Av: 8 mgKOH/g; hydroxyl value OHv: 23 mgKOH/g). Physical properties of this toner are shown in Tables 1-1 and 1-2, and the results of evaluation in Table 2.

Example 17

A cyan toner No. 17 was obtained in the same way as in Example 6 except that the polar resin A1 was changed for 20.0 parts of a polar resin A10 (styrene-methacrylic acid-methyl methacrylate copolymer; Mw: 10,500; Tg: 80° C.; acid value Av: 12 mgKOH/g) and that the polar resin B1 was changed for 5.0 parts of a polar resin B7 (polyester resin which is a polycondensation product of bisphenol A with terephthalic acid; Mw: 10,000; Tg: 80° C.; acid value Av: 10 mgKOH/g; hydroxyl value OHv: 21 mgKOH/g). Physical properties of this toner are shown in Tables 1-1 and 1-2, and the results of evaluation in Table 2.

Example 18

A cyan toner No. 18 was obtained in the same way as in Example 14 except that the polar resin B1 was changed for 5.0 parts of a polar resin B8 (polyester resin which is a polycondensation product of propylene oxide modified bisphenol A with terephthalic acid and adipic acid; Mw: 8,700; Tg: 59° C.; acid value Av: 10 mgKOH/g; hydroxyl value OHv: 15 mgKOH/g). Physical properties of this toner are shown in Tables 1-1 and 1-2, and the results of evaluation in Table 2.

Example 19

A cyan toner No. 19 was obtained in the same way as in Example 14 except that the polar resin B1 was changed for 5.0 parts of a polar resin B9 (polyester resin which is a polycondensation product of bisphenol A with terephthalic acid; Mw: 14,000; Tg: 81° C.; acid value Av: 9 mgKOH/g; hydroxyl value OHv: 21 mgKOH/g). Physical properties of this toner are shown in Tables 1-1 and 1-2, and the results of evaluation in Table 2.

Example 20

A cyan toner No. 20 was obtained in the same way as in Example 6 except that the polar resin A1 was changed for 20.0 parts of a polar resin A11 (styrene-methacrylic acid-methyl methacrylate copolymer; Mw: 9,900; Tg: 79° C.; acid value Av: 7 mgKOH/g). Physical properties of this toner are shown in Tables 1-1 and 1-2, and the results of evaluation in Table 2.

Example 21

A cyan toner No. 21 was obtained in the same way as in Example 6 except that the polar resin A1 was changed for 20.0 parts of a polar resin A12 (styrene-methacrylic acid-methyl methacrylate copolymer; Mw: 31,000; Tg: 102° C.; acid value Av: 11 mgKOH/g). Physical properties of this toner are shown in Tables 1-1 and 1-2, and the results of evaluation in Table 2.

Example 22

A cyan toner No. 22 was obtained in the same way as in Example 20 except that the polar resin B1 was changed for 5.0 parts of a polar resin B10 (polyester resin which is a polycondensation product of propylene oxide modified bisphenol A with terephthalic acid; Mw: 7,000; Tg: 65° C.; acid value Av: 15 mgKOH/g; hydroxyl value OHv: 29 mgKOH/g). Physical properties of this toner are shown in Tables 1-1 and 1-2, and the results of evaluation in Table 2.

Example 23

A cyan toner No. 23 was obtained in the same way as in Example 21 except that the polar resin B1 was changed for 5.0 parts of a polar resin B11 (polyester resin which is a polycondensation product of propylene oxide modified bisphenol A with terephthalic acid; Mw: 19,900; Tg: 77° C.; acid value Av: 10 mgKOH/g; hydroxyl value OHv: 9 mgKOH/g). Physical properties of this toner are shown in Tables 1-1 and 1-2, and the results of evaluation in Table 2.

Example 24

A cyan toner No. 24 was obtained in the same way as in Example 22 except that the polar resin A1 was changed for 20.0 parts of a polar resin A13 (styrene-methacrylic acid-methyl methacrylate copolymer; Mw: 8,000; Tg: 77° C.; acid value Av: 6 mgKOH/g). Physical properties of this toner are shown in Tables 1-1 and 1-2, and the results of evaluation in Table 2.

Example 25

A cyan toner No. 25 was obtained in the same way as in Example 6 except that the polar resin A1 was changed for 20.0 parts of a polar resin A14 (styrene-methacrylic acid-methyl methacrylate copolymer; Mw: 39,800; Tg: 103° C.; acid value Av: 25 mgKOH/g). Physical properties of this toner are shown in Tables 1-1 and 1-2, and the results of evaluation in Table 2.

Example 26

A cyan toner No. 26 was obtained in the same way as in Example 6 except that the polar resin A1 was changed for 20.0 parts of a polar resin A15 (styrene-methacrylic acid-methyl methacrylate copolymer; Mw: 48,000; Tg: 105° C.; acid value Av: 29 mgKOH/g). Physical properties of this toner are shown in Tables 1-1 and 1-2, and the results of evaluation in Table 2.

Example 27

A cyan toner No. 27 was obtained in the same way as in Example 6 except that the polar resin A1 was changed for 20.0 parts of a polar resin A13 (styrene-methacrylic acid-methyl methacrylate copolymer; Mw: 8,000; Tg: 77° C.; acid value Av: 6 mgKOH/g). Physical properties of this toner are shown in Tables 1-1 and 1-2, and the results of evaluation in Table 2.

Example 28

A cyan toner No. 28 was obtained in the same way as in Example 6 except that the polar resin A1 was changed for 20.0 parts of a polar resin A16 (styrene-methacrylic acid-methyl methacrylate copolymer; Mw: 17,000; Tg: 90° C.; acid value Av: 3 mgKOH/g; hydroxyl value OHv: 40 mgKOH/g) and that the polar resin B1 was changed for 5.0 parts of a polar resin B12 (polyester resin which is a polycondensation product of propylene oxide modified bisphenol A with terephthalic acid and adipic acid; Mw: 4,900; Tg: 58° C.; acid value Av: 8 mgKOH/g; hydroxyl value OHv: 40 mgKOH/g). Physical properties of this toner are shown in Tables 1-1 and 1-2, and the results of evaluation in Table 2.

Example 29

A cyan toner No. 29 was obtained in the same way as in Example 6 except that the polar resin A1 was changed for 20.0 parts of a polar resin A17 (styrene-methacrylic acid-methyl methacrylate copolymer; Mw: 29,000; Tg: 99° C.; acid value Av: 15 mgKOH/g) and that the polar resin B1 was changed for 5.0 parts of a polar resin B13 (polyester resin which is a polycondensation product of bisphenol A with terephthalic acid; Mw: 25,500; Tg: 81° C.; acid value Av: 15 mgKOH/g; hydroxyl value OHv: 4 mgKOH/g). Physical properties of this toner are shown in Tables 1-1 and 1-2, and the results of evaluation in Table 2.

Example 30

A cyan toner No. 30 was obtained in the same way as in Example 22 except that the polar resin A11 was changed for 20.0 parts of a polar resin A18 (styrene-methacrylic acid-methyl methacrylate copolymer; Mw: 7,800; Tg: 77° C.; acid value Av: 8 mgKOH/g). Physical properties of this toner are shown in Tables 1-1 and 1-2, and the results of evaluation in Table 2.

Example 31

A cyan toner No. 31 was obtained in the same way as in Example 6 except that the polar resin A1 was changed for 20.0 parts of a polar resin A19 (styrene-methacrylic acid-methyl methacrylate copolymer; Mw: 51,000; Tg: 105° C.; acid value Av: 30 mgKOH/g). Physical properties of this toner are shown in Tables 1-1 and 1-2, and the results of evaluation in Table 2.

Example 32

A cyan toner No. 32 was obtained in the same way as in Example 29 except that the polar resin A17 was changed for 20.0 parts of a polar resin A14 (styrene-methacrylic acid-methyl methacrylate copolymer; Mw: 39,800; Tg: 103° C.; acid value Av: 25 mgKOH/g). Physical properties of this toner are shown in Tables 1-1 and 1-2, and the results of evaluation in Table 2.

Example 33

A cyan toner No. 33 was obtained in the same way as in Example 6 except that the polar resin A1 was changed for 5.0 parts of a polar resin A19 (styrene-methacrylic acid-methyl methacrylate copolymer; Mw: 51,000; Tg: 105° C.; acid value Av: 30 mgKOH/g) and that the polar resin B1 was changed for 20.0 parts of a polar resin B11 (polyester resin which is a polycondensation product of propylene oxide modified bisphenol A with terephthalic acid; Mw: 19,900; Tg: 77° C.; acid value Av: 10 mgKOH/g; hydroxyl value OHv: 9 mgKOH/g). Physical properties of this toner are shown in Tables 1-1 and 1-2, and the results of evaluation in Table 2.

Example 34

A cyan toner No. 34 was obtained in the same way as in Example 33 except that the amount of the polar resin A19 (styrene-methacrylic acid-methyl methacrylate copolymer; Mw: 51,000; Tg: 105° C.; acid value Av: 30 mgKOH/g) was changed to 10.0 parts and that the amount of the polar resin B11 (polyester resin which is a polycondensation product of propylene oxide modified bisphenol A with terephthalic acid; Mw: 19,900; Tg: 77° C.; acid value Av: 10 mgKOH/g; hydroxyl value OHv: 9 mgKOH/g) was changed to 15.0 parts. Physical properties of this toner are shown in Tables 1-1 and 1-2, and the results of evaluation in Table 2.

Example 35

A cyan toner No. 35 was obtained in the same way as in Example 34 except that, after the coarse powder was removed with use of a sieve of 150 μm in mesh opening, fine powder was removed by air classification to control the particle diameter. Physical properties of this toner are shown in Tables 1-1 and 1-2, and the results of evaluation in Table 2.

Example 36

A cyan toner No. 36 was obtained in the same way as in Example 1 except that the amount of C.I. Pigment Blue 15:3 was changed to 4.5 parts and that, in the mixing control step, after the polymerizable monomer composition 1 was mixed into the polymerizable monomer composition 2, these were stirred for 5 minutes and thereafter the polymerizable monomer compositions 1 and 2 were stirred for 30 minutes under application of shear at a high speed by using the stirring apparatus shown in FIGS. 3A to 5. Physical properties of this toner are shown in Tables 1-1 and 1-2, and the results of evaluation in Table 2.

Example 37

A cyan toner No. 37 was obtained in the same way as in Example 1 except that the amount of C.I. Pigment Blue 15:3 was changed to 4.5 parts and that, in the mixing control step, after the polymerizable monomer composition 1 was mixed into the polymerizable monomer composition 2, these were stirred for 5 minutes and thereafter the polymerizable monomer compositions 1 and 2 were mixed for 30 minutes by using the mixing apparatus shown in FIGS. 6 and 7. Physical properties of this toner are shown in Tables 1-1 and 1-2, and the results of evaluation in Table 2.

Comparative Example 1

A cyan toner No. 38 was obtained in the same way as in Example 6 except that the polar resin A1 was changed for 20.0 parts of a polar resin A20 (styrene-methacrylic acid-methyl methacrylate-2-hydroxyethyl methacrylate copolymer; Mw: 53,000; Tg: 106° C.; acid value Av: 35 mgKOH/g; hydroxyl value OHv: 15 mgKOH/g) and that the polar resin B1 was changed for a styrene-methacrylic acid-methyl methacrylate copolymer (Mw: 7,800; Tg: 77° C.; acid value Av: 8 mgKOH/g). Physical properties of this toner are shown in Tables 1-1 and 1-2, and the results of evaluation in Table 2.

Comparative Example 2

A cyan toner No. 39 was obtained in the same way as in Example 6 except that the polar resin A1 was changed for 4.0 parts of a polar resin A20 (styrene-methacrylic acid-methyl methacrylate-2-hydroxyethyl methacrylate copolymer; Mw: 53,000; Tg: 106° C.; acid value Av: 35 mgKOH/g; hydroxyl value OHv: 15 mgKOH/g) and that the polar resin B1 was changed for 30.0 parts of a polar resin B12 (polyester resin which is a polycondensation product of propylene oxide modified bisphenol A with terephthalic acid and adipic acid; Mw: 4,900; Tg: 58° C.; acid value Av: 8 mgKOH/g; hydroxyl value OHv: 40 mgKOH/g). Physical properties of this toner are shown in Tables 1-1 and 1-2, and the results of evaluation in Table 2.

Comparative Example 3

A cyan toner No. 40 was obtained in the same way as in Example 6 except that, in preparing the polymerizable monomer composition 1, the amount of the divinylbenzene was changed to 1.0 part and, in preparing the polymerizable monomer composition 2, the amounts of the styrene and n-Butyl acrylate were changed to 55 parts and 15 parts, respectively, and that the polar resin A1 was not added and the polar resin B1 was changed for 5.0 parts of a polar resin B13 (polyester resin which is a polycondensation product of bisphenol A with terephthalic acid; Mw: 25,500; Tg: 81° C.; acid value Av: 15 mgKOH/g; hydroxyl value OHv: 4 mgKOH/g). Physical properties of this toner are shown in Tables 1-1 and 1-2, and the results of evaluation in Table 2.

Comparative Example 4

A cyan toner No. 41 was obtained in the same way as in Example 6 except that the polar resin A1 was not added and the polar resin B1 was changed for 5.0 parts of a polar resin B12 (polyester resin which is a polycondensation product of propylene oxide modified bisphenol A with terephthalic acid and adipic acid; Mw: 4,900; Tg: 58° C.; acid value Av: 8 mgKOH/g; hydroxyl value OHv: 40 mgKOH/g). Physical properties of this toner are shown in Tables 1-1 and 1-2, and the results of evaluation in Table 2.

TABLE 1-1

| Toner No. | X(25)/D | [X(50) − X(25)]/X(25) × 100 | Num. av. particle diam. D1 (μm) | Average circularity | Number of particles: of less than 0.98 in circularity | Number of particles: of less than 2 μm in diam. |
|---|---|---|---|---|---|---|
| No. 1 | 0.16 | 104 | 5.5 | 0.988 | 8 | 8 |
| No. 2 | 0.21 | 117 | 5.5 | 0.987 | 9 | 10 |
| No. 3 | 0.13 | 101 | 5.6 | 0.986 | 10 | 7 |
| No. 4 | 0.24 | 120 | 5.5 | 0.988 | 9 | 10 |
| No. 5 | 0.10 | 100 | 5.6 | 0.985 | 11 | 9 |
| No. 6 | 0.15 | 95 | 5.6 | 0.989 | 10 | 7 |
| No. 7 | 0.10 | 90 | 5.5 | 0.971 | 20 | 15 |
| No. 8 | 0.25 | 99 | 5.4 | 0.980 | 15 | 13 |

TABLE 1-1-continued

| Toner No. | X(25)/D | [X(50) − X(25)]/X(25) × 100 | Num. av. particle diam. D1 (μm) | Average circularity | Number of particles: of less than 0.98 in circularity | Number of particles: of less than 2 μm in diam. |
|---|---|---|---|---|---|---|
| No. 9 | 0.25 | 85 | 5.7 | 0.998 | 3 | 2 |
| No. 10 | 0.27 | 130 | 5.6 | 0.976 | 20 | 11 |
| No. 11 | 0.13 | 91 | 5.4 | 0.979 | 16 | 13 |
| No. 12 | 0.13 | 91 | 5.4 | 0.988 | 10 | 9 |
| No. 13 | 0.12 | 82 | 5.3 | 0.960 | 30 | 20 |
| No. 14 | 0.14 | 85 | 5.7 | 0.993 | 6 | 6 |
| No. 15 | 0.16 | 88 | 5.7 | 0.993 | 5 | 5 |
| No. 16 | 0.15 | 81 | 5.7 | 0.995 | 4 | 6 |
| No. 17 | 0.27 | 132 | 5.6 | 0.989 | 10 | 8 |
| No. 18 | 0.31 | 139 | 5.7 | 0.992 | 6 | 5 |
| No. 19 | 0.15 | 79 | 5.7 | 0.993 | 6 | 6 |
| No. 20 | 0.29 | 135 | 5.7 | 0.995 | 3 | 4 |
| No. 21 | 0.16 | 72 | 5.7 | 0.991 | 7 | 6 |
| No. 22 | 0.29 | 137 | 5.6 | 0.984 | 14 | 13 |
| No. 23 | 0.16 | 71 | 5.7 | 0.991 | 8 | 7 |
| No. 24 | 0.33 | 139 | 5.7 | 0.986 | 12 | 11 |
| No. 25 | 0.15 | 70 | 5.6 | 0.969 | 25 | 17 |
| No. 26 | 0.12 | 65 | 5.5 | 0.964 | 27 | 18 |
| No. 27 | 0.16 | 66 | 5.8 | 0.996 | 2 | 3 |
| No. 28 | 0.30 | 149 | 5.9 | 0.995 | 6 | 5 |
| No. 29 | 0.13 | 58 | 5.6 | 0.977 | 19 | 11 |
| No. 30 | 0.34 | 142 | 5.7 | 0.977 | 19 | 12 |
| No. 31 | 0.12 | 52 | 5.5 | 0.963 | 28 | 18 |
| No. 32 | 0.12 | 34 | 5.4 | 0.961 | 29 | 18 |
| No. 33 | 0.14 | 48 | 5.2 | 0.957 | 31 | 25 |
| No. 34 | 0.13 | 40 | 5.3 | 0.968 | 27 | 21 |
| No. 35 | 0.11 | 33 | 5.5 | 0.981 | 12 | 1 |
| No. 36 | 0.16 | 106 | 5.5 | 0.990 | 7 | 6 |
| No. 37 | 0.16 | 105 | 5.5 | 0.989 | 7 | 7 |
| No. 38 | 0.14 | 29 | 5.4 | 0.949 | 38 | 26 |
| No. 39 | 0.33 | 151 | 5.1 | 0.946 | 40 | 29 |
| No. 40 | 0.09 | 61 | 5.5 | 0.991 | 5 | 3 |
| No. 41 | 0.36 | 40 | 5.2 | 0.951 | 36 | 27 |

TABLE 1-2

| | Polar resin A | | | | | | Polar resin B | | | | | | | Polar resin C | | |
|---|---|---|---|---|---|---|---|---|---|---|---|---|---|---|---|---|
| Toner No. | Resin No. | Amt. (pbm) | Mw | Tg (° C.) | Av | OHv | Resin No. | Resin make-up | Amt. (pbm) | Mw | Tg (° C.) | Av | OHv | Resin No. | Tg (° C.) | Remarks |
| 1 | A1 | 20 | 14,800 | 89 | 22 | 8 | B1 | PES | 5 | 9,500 | 74 | 9 | 25 | C1 | 81 | |
| 2 | A1 | 20 | 14,800 | 89 | 22 | 8 | B1 | PES | 5 | 9,500 | 74 | 9 | 25 | C2 | 70 | |
| 3 | A1 | 20 | 14,800 | 89 | 22 | 8 | B1 | PES | 5 | 9,500 | 74 | 9 | 25 | C3 | 90 | |
| 4 | A1 | 20 | 14,800 | 89 | 22 | 8 | B1 | PES | 5 | 9,500 | 74 | 9 | 25 | C4 | 68 | |
| 5 | A1 | 20 | 14,800 | 89 | 22 | 8 | B1 | PES | 5 | 9,500 | 74 | 9 | 25 | C5 | 92 | |
| 6 | A1 | 20 | 14,800 | 89 | 22 | 8 | B1 | PES | 5 | 9,500 | 74 | 9 | 25 | | None | |
| 7 | A2 | 20 | 18,500 | 90 | 28 | 5 | B1 | PES | 5 | 9,500 | 74 | 9 | 25 | | None | |
| 8 | A3 | 20 | 26,500 | 95 | 5 | 49 | B2 | PES | 5 | 5,500 | 64 | 25 | 35 | | None | |
| 9 | A4 | 20 | 14,800 | 89 | 12 | 18 | B3 | Styl. | 5 | 11,000 | 64 | 12 | 21 | | None | |
| 10 | A5 | 20 | 11,400 | 82 | 25 | 4 | B1 | PES | 5 | 9,500 | 74 | 9 | 25 | | None | |
| 11 | A6 | 20 | 28,400 | 97 | 8 | 51 | B2 | PES | 5 | 5,500 | 64 | 25 | 35 | | None | |
| 12 | A7 | 20 | 25,300 | 95 | 4 | 40 | B4 | PES | 5 | 7,600 | 67 | 20 | 27 | | None | |
| 13 | A8 | 20 | 23,000 | 94 | 31 | 8 | B4 | PES | 5 | 7,600 | 67 | 20 | 27 | | None | |
| 14 | A9 | 20 | 15,300 | 88 | 10 | 0 | B1 | PES | 5 | 9,500 | 74 | 9 | 25 | | None | |
| 15 | A9 | 20 | 15,300 | 88 | 10 | 0 | B5 | PES | 5 | 9,000 | 61 | 9 | 17 | | None | |
| 16 | A9 | 20 | 15,300 | 88 | 10 | 0 | B6 | PES | 5 | 11,900 | 78 | 8 | 23 | | None | |
| 17 | A10 | 20 | 10,500 | 80 | 12 | 0 | B7 | PES | 5 | 10,000 | 80 | 10 | 21 | | None | |
| 18 | A9 | 20 | 15,300 | 88 | 10 | 0 | B8 | PES | 5 | 8,700 | 59 | 10 | 15 | | None | |
| 19 | A9 | 20 | 15,300 | 88 | 10 | 0 | B9 | PES | 5 | 14,000 | 81 | 9 | 21 | | None | |
| 20 | A11 | 20 | 9,900 | 79 | 7 | 0 | B1 | PES | 5 | 9,500 | 74 | 9 | 25 | | None | |
| 21 | A12 | 20 | 31,000 | 102 | 11 | 0 | B1 | PES | 5 | 9,500 | 74 | 9 | 25 | | None | |
| 22 | A11 | 20 | 9,900 | 79 | 7 | 0 | B10 | PES | 5 | 7,000 | 65 | 15 | 29 | | None | |
| 23 | A12 | 20 | 31,000 | 102 | 11 | 0 | B11 | PES | 5 | 19,900 | 77 | 10 | 9 | | None | |
| 24 | A13 | 20 | 8,000 | 77 | 6 | 0 | B10 | PES | 5 | 7,000 | 65 | 15 | 29 | | None | |
| 25 | A14 | 20 | 39,800 | 103 | 25 | 0 | B1 | PES | 5 | 9,500 | 74 | 9 | 25 | | None | |

TABLE 1-2-continued

| | Polar resin A | | | | | | Polar resin B | | | | | | | Polar resin C | | |
|---|---|---|---|---|---|---|---|---|---|---|---|---|---|---|---|---|
| Toner No. | Resin No. | Amt. (pbm) | Mw | Tg (° C.) | Av | OHv | Resin No. | Resin make-up | Amt. (pbm) | Mw | Tg (° C.) | Av | OHv | Resin No. | Tg (° C.) | Remarks |
| 26 | A15 | 20 | 48,000 | 105 | 29 | 0 | B1 | PES | 5 | 9,500 | 74 | 9 | 25 | | None | |
| 27 | A13 | 20 | 8,000 | 77 | 6 | 0 | B1 | PES | 5 | 9,500 | 74 | 9 | 25 | | None | |
| 28 | A16 | 20 | 17,000 | 90 | 3 | 40 | B12 | PES | 5 | 4,900 | 58 | 8 | 40 | | None | |
| 29 | A17 | 20 | 29,000 | 99 | 15 | 0 | B13 | PES | 5 | 25,500 | 81 | 15 | 4 | | None | |
| 30 | A18 | 20 | 7,800 | 77 | 8 | 0 | B10 | PES | 5 | 7,000 | 65 | 15 | 29 | | None | |
| 31 | A19 | 20 | 51,000 | 105 | 30 | 0 | B1 | PES | 5 | 9,500 | 74 | 9 | 25 | | None | |
| 32 | A14 | 20 | 39,800 | 103 | 25 | 0 | B13 | PES | 5 | 25,500 | 81 | 15 | 4 | | None | |
| 33 | A19 | 5 | 51,000 | 105 | 30 | 0 | B11 | PES | 20 | 19,900 | 77 | 10 | 9 | | None | |
| 34 | A19 | 10 | 51,000 | 105 | 30 | 0 | B11 | PES | 15 | 19,900 | 77 | 10 | 9 | | None | |
| 35 | A19 | 10 | 51,000 | 105 | 30 | 0 | B11 | PES | 15 | 19,900 | 77 | 10 | 9 | | None | Air classifier used. |
| 36 | A1 | 20 | 14,800 | 89 | 22 | 8 | B1 | PES | 5 | 9,500 | 74 | 9 | 25 | C1 | 81 | *1 |
| 37 | A1 | 20 | 14,800 | 89 | 22 | 8 | B1 | PES | 5 | 9,500 | 74 | 9 | 25 | C1 | 81 | *2 |
| 38 | A20 | 20 | 53,000 | 106 | 35 | 15 | B14* | Styl. | 5 | 7,800 | 77 | 8 | 0 | | None | *(=A18) |
| 39 | A20 | 4 | 53,000 | 106 | 35 | 15 | B12 | PES | 30 | 4,900 | 58 | 8 | 40 | | None | |
| 40 | | | None | | | | B13 | PES | 5 | 25,500 | 81 | 15 | 4 | | None | *3 |
| 41 | | | None | | | | B12 | PES | 25 | 4,900 | 58 | 8 | 40 | | None | |

*1: High-speed shear stirrer is used in mixing control step; amount of colorant is changed.
*2: Mixing apparatus having rotor and stator is used in mixing control step; amount of colorant is changed.
*3: St/Ac ratio and amount of divinylbenzene added are changed.

TABLE 2

| | Developing performance, transfer performance & cleaning performance | | | | | | | | | Fixing performance | | | |
|---|---|---|---|---|---|---|---|---|---|---|---|---|---|
| | Image density | Glossiness | Fog | Rise of charging | Transfer uniformity | High = print image density | Cleaning performance | Toner scatter | Lines in periph. dirc. | Blister | Folding | High = temp. offset | Storage Blocking |
| Example: | | | | | | | | | | | | | |
| 1 | A(1.42) | A(23) | A(0.2%) | A | A | A(2%) | A | A | A | A | A(2%) | A | A |
| 2 | A(1.42) | A(23) | A(0.2%) | A | B | A(2%) | A | A | A | A | A(2%) | A | A |
| 3 | A(1.42) | A(23) | A(0.2%) | A | A | B(3%) | A | A | A | A | A(2%) | A | A |
| 4 | A(1.42) | A(22) | A(0.2%) | A | B | B(3%) | A | A | A | A | A(2%) | A | A |
| 5 | A(1.42) | A(22) | A(0.2%) | A | B | B(3%) | A | A | A | A | A(2%) | A | A |
| 6 | A(1.41) | A(23) | A(0.3%) | B | B | B(3%) | A | A | A | A | A(2%) | A | A |
| 7 | A(1.41) | A(21) | A(0.4%) | B | B | B(3%) | A | A | A | A | A(2%) | A | A |
| 8 | A(1.41) | A(22) | A(0.4%) | B | B | B(3%) | A | A | A | A | A(3%) | A | A |
| 9 | A(1.40) | A(20) | A(0.2%) | B | B | B(4%) | A | A | A | A | B(5%) | A | A |
| 10 | A(1.41) | A(24) | A(0.3%) | B | B | B(3%) | A | A | A | A | A(2%) | B | A |
| 11 | A(1.41) | B(19) | A(0.4%) | B | B | B(3%) | A | A | A | A | A(3%) | A | A |
| 12 | A(1.41) | A(22) | A(0.4%) | B | B | B(3%) | A | A | A | A | A(3%) | B | A |
| 13 | A(1.41) | A(22) | B(0.5%) | B | B | B(3%) | A | A | A | A | A(3%) | A | A |
| 14 | A(1.41) | A(23) | A(0.3%) | B | B | B(4%) | A | A | A | A | A(2%) | B | B |
| 15 | A(1.41) | A(23) | A(0.4%) | B | B | B(4%) | A | A | A | A | A(2%) | B | B |
| 16 | A(1.41) | A(23) | A(0.3%) | B | B | B(4%) | A | A | A | A | A(4%) | B | B |
| 17 | A(1.41) | A(24) | A(0.3%) | B | B | B(3%) | A | A | A | A | B(5%) | B | B |
| 18 | A(1.41) | A(23) | B(0.5%) | B | B | B(4%) | A | A | A | A | A(2%) | B | B |
| 19 | A(1.41) | A(23) | A(0.3%) | B | B | B(4%) | A | A | A | A | B(5%) | B | B |
| 20 | A(1.41) | A(24) | A(0.3%) | B | B | B(4%) | A | A | A | A | A(2%) | C | B |
| 21 | A(1.41) | B(18) | A(0.3%) | B | B | B(4%) | A | A | A | A | C(10%) | A | A |
| 22 | A(1.41) | A(24) | A(0.4%) | B | B | B(3%) | A | A | A | A | A(2%) | C | B |
| 23 | A(1.41) | B(18) | A(0.3%) | B | B | B(4%) | A | A | A | A | C(10%) | A | A |
| 24 | A(1.41) | A(24) | A(0.4%) | B | B | B(3%) | A | A | A | A | A(2%) | C | B |
| 25 | A(1.41) | B(17) | A(0.3%) | B | B | B(3%) | A | A | A | A | C(11%) | A | A |
| 26 | A(1.41) | B(16) | A(0.3%) | B | B | B(3%) | A | A | A | A | C(11%) | A | A |
| 27 | A(1.40) | A(24) | B(0.5%) | B | B | C(5%) | A | A | A | A | A(2%) | B | B |
| 28 | A(1.40) | A(23) | B(0.6%) | B | B | C(5%) | A | A | A | A | A(2%) | C | C |
| 29 | A(1.40) | C(14) | A(0.3%) | B | B | B(3%) | A | A | A | C | C(10%) | A | A |
| 30 | A(1.40) | A(24) | B(0.6%) | B | B | C(5%) | A | A | B | A | A(2%) | B | C |
| 31 | A(1.40) | B(15) | A(0.3%) | B | B | C(7%) | B | A | A | B | C(12%) | A | A |
| 32 | B(1.37) | C(14) | B(0.7%) | C | C | C(6%) | B | A | A | C | C(11%) | A | A |
| 33 | C(1.20) | C(13) | C(1.1%) | C | C | C(8%) | B | C | C | C | C(13%) | C | C |
| 34 | C(1.28) | C(12) | C(1.3%) | C | B | B(4%) | B | C | C | C | C(14%) | C | B |
| 35 | C(1.34) | C(12) | B(0.9%) | C | B | C(8%) | C | B | B | C | C(13%) | C | B |

TABLE 2-continued

| | Developing performance, transfer performance & cleaning performance | | | | | | | | | Fixing performance | | | |
|---|---|---|---|---|---|---|---|---|---|---|---|---|---|
| | Image density | Glossiness | Fog | Rise of charging | Transfer uniformity | High = print image density | Cleaning performance | Toner scatter | Lines in periph. dirc. | Blister | Folding | High = temp. offset | Storage Blocking |
| 36 | A(1.43) | A(24) | A(0.1%) | A | A | A(1%) | A | A | A | A | A(1%) | A | A |
| 37 | A(1.43) | A(24) | A(0.1%) | A | A | A(1%) | A | A | A | A | A(1%) | A | A |
| | | | | | | Comparative Example: | | | | | | | |
| 1 | C(1.09) | D(9) | C(1.2%) | C | C | C(9%) | B | B | B | D | D(17%) | C | C |
| 2 | C(1.04) | C(11) | D(1.6%) | B | C | D(12%) | C | D | D | C | C(14%) | D | C |
| 3 | C(1.15) | D(7) | C(1.4%) | A | C | D(10%) | D | B | A | D | D(15%) | A | D |
| 4 | D(0.99) | A(23) | D(1.8%) | A | D | D(11%) | D | D | D | B | B(8%) | B | B |

REFERENCE SIGNS LIST

1: stirring blade
2: screening member
3: stirring framework
4: dispersion container
5: expelling outlet
6: jacket
7: holding tank
8: stirring-blade unit
9: circulating pump
10: dispersion container inlet
11: sucking inlet
12: discharge outlet
13: heat exchanger
14: flow meter
15: pressure control valve
16: lower-part motor
17: upper-part motor
18: cover member
19: supporting cylinder
20: upper-part rotating shaft
21: mechanical seal
23: partition
24: lower-part rotating shaft
25: pressure gauge
26: thermometer
62: support roller
63: support
64: low heat capacitance linear heating medium
64*a*: heater substrate
64*b*, electrification heat-generating resistor (heating element)
64*c*: surface protective layer
64*d*: temperature detector
65: heat-resistant film
101: mixing apparatus
102: casing:
108: holding tank
109: pressure gauge
110: circulating pump
111: heat exchanger
112: thermometer
118: jacket
121: stator
125: rotor
122, 128: ring-shaped projections
126: shear gap
129: feed pipe
130: rotating shaft While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-080265, filed Mar. 31, 2010, which is hereby incorporated by reference herein in its entirety.

The invention claimed is:

1. A toner which comprises:

toner particles, and an inorganic fine powder;

wherein the toner particles are obtained by the following steps of:

adding to an aqueous medium a polymerizable monomer composition containing at least:

a polymerizable monomer, a colorant, and a polar resin comprising a polar resin-A, a polar resin-B, and a polar resin-C, granulating the polymerizable monomer composition in the aqueous medium to form particles of the polymerizable monomer composition, and polymerizing the polymerizable monomer contained in the particles of the polymerizable monomer composition;

wherein, in displacement levels found in a micro-compression test in which a force is applied to one of the toner particles at a loading rate of $9.8\times10^{-6}$ N/sec to measure a displacement level (μm) at a point of time where the force has reached a maximum force of $4.90\times10^{-4}$ N, the displacement level at a measurement temperature of 25° C. is represented by X(25), the displacement level at a measurement temperature of 50° C. is represented by X(50), and the number average particle diameter of the toner is represented by D (μm), the X(25), the X(50) and the D satisfy the following relations (1) and (2):

$$0.10\leq X(25)/D\leq 0.35 \quad (1), \text{ and}$$

$$30\leq [X(50)-X(25)]/X(25)\times 100\leq 150 \quad (2),$$

wherein, the acid value of the polar resin-A is represented by Av(A), the hydroxyl value of the polar resin-A is represented by OHv(A), the acid value of the polar resin-B is represented by Av(B), and the hydroxyl value of the polar resin-B is represented by OHv(B), the Av(A), the OHv(A), the Av(B), and the OHv(B) satisfy the following relation (3):

$$Av(A)+OHv(A)<Av(B)+OHv(B) \quad (3), \text{ and}$$

wherein, the polar resin-C is a polymer or copolymer having a sulfonic acid group, a sulfonic salt group or a sulfonic ester group; and the polar resin-C has a glass transition point Tg (C) of from 70° C. to 90° C.; and the glass transition point Tg (A) of the polar resin-A, the glass transition point Tg (B) of the polar resin-B and the glass transition point Tg (C) satisfy the following relation (4):

$$Tg(B)\leq Tg(C)<Tg(A) \quad (4).$$

2. The toner according to claim 1, which has an average circularity of from 0.960 to 1.000 as measured with a flow particle image analyzer, where particles having an average circularity of less than 0.960 is in a number of from 2% by number to 30% by number and particles having a particle diameter of less than 2 μm is in a number of from 2% by number to 20% by number.

3. The toner according to claim 1, wherein the polar resin A has a weight-average molecular weight Mw(A) of from 8,000 to 50,000 and the polar resin B has a weight-average molecular weight Mw(B) of from 5,000 to 25,000 as measured by gel permeation chromatography, and Mw(B)<Mw(A).

4. The toner according to claim 1, wherein the polar resin A has a glass transition point Tg(A) of from 80° C. to 100° C. and the polar resin B has a glass transition point Tg(B) of from 60° C. to 80° C., and Tg(B)<Tg(A).

5. The toner according to claim 1, wherein the polar resin A has an acid value Av(A) of from 5 mgKOH/g to 30 mgKOH/g and a hydroxyl value OHv(A) of from 5 mgKOH/g to 50 mgKOH/g.

6. The toner according to claim 1, wherein the polar resin B is a polyester resin.

7. A process for producing a toner; the process comprising the steps of:

adding to an aqueous medium a polymerizable monomer composition containing at least:

a polymerizable monomer, a colorant, and a polar resin comprising a polar resin-A, a polar resin-B, and a polar resin-C, granulating the polymerizable monomer composition in the aqueous medium to form particles of the polymerizable monomer composition, and polymerizing the polymerizable monomer contained in the particles of the polymerizable monomer composition, to obtain toner particles;

wherein, in displacement levels found in a micro-compression test in which a force is applied to one of the toner particles at a loading rate of $9.8\times10^{-6}$ N/sec to measure a displacement level (μm) at a point of time where the force has reached a maximum force of $4.90\times10^{-4}$ N, the displacement level at a measurement temperature of 25° C. is represented by X(25), the displacement level at a measurement temperature of 50° C. by X(50), and the number average particle diameter of the toner is represented by D (μm), the X(25), the X(50) and the D satisfy the following relations (1) and (2):

$$0.10\leq X(25)/D\leq 0.35 \quad (1), \text{ and}$$

$$30\leq [X(50)-X(25)]/X(25)\times 100\leq 150 \quad (2),$$

wherein, the acid value of the polar resin-A is represented by Av(A), the hydroxyl value of the polar resin-A is represented by OHv(A), the acid value of the polar resin-B is represented by Av(B), and the hydroxyl value of the polar resin-B is represented by OHv(B), the Av(A), the OHv(A), the Av(B), and the OHv(B) satisfy the following relation (3):

$$Av(A)+OHv(A)<Av(B)+OHv(B) \quad (3), \text{ and}$$

wherein, the polar resin-C is a polymer or copolymer having a sulfonic acid group, a sulfonic salt group or a sulfonic ester group; and the polar resin-C has a glass transition point Tg (C) of from 70° C. to 90° C.; and the glass transition point Tg (A) of the polar resin-A, the glass transition point Tg (B) of the polar resin-B and the glass transition point Tg (C) satisfy the following relation (4):

$$Tg(B)\leq Tg(C)<Tg(A) \quad (4).$$

8. A process for producing a toner according to claim 7, which further comprises the step of, before adding the polymerizable monomer composition to the aqueous medium, treating the polymerizable monomer composition by using a stirring apparatus comprising a stirring blade which is rotatable at a high speed and a screening member which is provided around the stirring blade and rotatable at a high speed in the direction opposite to the stirring blade.

9. A process for producing a toner according to claim 7, which further comprises the step of, before adding the polymerizable monomer composition to the aqueous medium, treating the polymerizable monomer composition by using a stirring apparatus comprising a rotor and a stator which each have such a shape that ring-shaped projections having a plurality of shear planes and faces are formed multiply in the form of concentric circles, and are coaxially face to face placed in such a way that the both engage with each other leaving a constant distance between them.

* * * * *